US010070217B2

(12) United States Patent
Hardesty

(10) Patent No.: US 10,070,217 B2
(45) Date of Patent: Sep. 4, 2018

(54) SPEAKER APPARATUS

(71) Applicant: PANASONIC INTELLECTUAL PROPERTY MANAGEMENT CO., LTD., Osaka (JP)

(72) Inventor: Gary Allen Hardesty, Northridge, CA (US)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/439,392

(22) Filed: Feb. 22, 2017

(65) Prior Publication Data

US 2018/0227663 A1 Aug. 9, 2018

(30) Foreign Application Priority Data

Feb. 3, 2017 (JP) ..... 2017-019026

(51) Int. Cl.
*H04R 1/02* (2006.01)
*H04R 1/40* (2006.01)
*H04R 3/14* (2006.01)

(52) U.S. Cl.
CPC ..... *H04R 1/403* (2013.01); *H04R 3/14* (2013.01); *H04R 1/023* (2013.01)

(58) Field of Classification Search
CPC ..... H04R 1/30; H04R 1/345; H04R 1/2861; G10K 11/02; G10K 11/025; G10K 9/00
USPC ..... 181/152, 159, 177, 187; 381/339, 340
See application file for complete search history.

(56) References Cited

U.S. PATENT DOCUMENTS 6,394,223 B1 * 5/2002 Lehman ..... H04R 1/345 181/152
6,557,664 B1 * 5/2003 Andrews ..... H04R 1/30 181/152
2004/0005069 A1 * 1/2004 Buck ..... H04R 1/30 381/336

* cited by examiner

*Primary Examiner* — Sunita Joshi
(74) *Attorney, Agent, or Firm* — Greenblum & Bernstein, P.L.C.

(57) ABSTRACT

A speaker apparatus includes first acoustic drivers that respectively output first acoustic signals, and an acoustic coupler having acoustic passages. The acoustic passages respectively include inlets, and an outlet of the acoustic passages is common. The first acoustic signals output from the first acoustic drivers are respectively inlet into the inlets, the first acoustic signals inlet into the inlets are guided to the common outlet, the first acoustic signals are combined at the common outlet to generate a second acoustic signal, and the second acoustic signal is output. Lengths of the acoustic passages from the inlets to the common outlet are identical to each other.

4 Claims, 24 Drawing Sheets
(3 of 24 Drawing Sheet(s) Filed in Color)

SPEAKER APPARATUS

CROSS-REFERENCES TO RELATED APPLICATION(S)

This application is based on and claims priority from Japanese Patent Application No. 2017-019026 filed on Feb. 3, 2017, the entire contents of which are incorporated herein by reference.

BACKGROUND

1. Field of the Invention

This disclosure relates to a speaker apparatus.

2. Description of Related Art

U.S. Pat. No. 6,394,223 discloses a loudspeaker that is equipped with a waveguide, plural drivers, and plural throats which are coupled acoustically to the respective drivers at their inlets and coupled acoustically to the waveguide at their outlets. In the loudspeaker, an axis of each throat forms an arc in a plane including a longer axis of the waveguide to optimize an acoustic energy distribution in the plane.

In the loudspeaker, for coupling of acoustic signals at the outlet to the waveguide, the throats need to be positioned to each other accurately. Otherwise, a phase deviation tends to occur between acoustic signals that are generated by the drivers and output from the throats.

In the loudspeaker, since an MF (medium-frequency) speaker and an HF (high-frequency) speaker are disposed separately, phase deviation is prone to occur between acoustic signals that are output from the MF speaker and acoustic signals that are output from the HF speaker.

Still further, since the outlets of the throats corresponding to the respective drivers are arranged in line in a longer axis direction at the sound hole of the waveguide, the acoustic energy (power) tends to be insufficient.

SUMMARY

Exemplary embodiments relate to a speaker apparatus capable of reducing phase deviation between sets of acoustic signals that are output from respective acoustic drivers and outputting acoustic signals having large acoustic energy.

In accordance with exemplary embodiments, a speaker apparatus includes first acoustic drivers that respectively output first acoustic signals, and an acoustic coupler having acoustic passages. The acoustic passages respectively include inlets, and an outlet of the acoustic passages is common. The first acoustic signals output from the first acoustic drivers are respectively inlet into the inlets, the first acoustic signals inlet into the inlets are guided to the common outlet, the first acoustic signals are combined at the common outlet to generate a second acoustic signal, and the second acoustic signal is output. Lengths of the acoustic passages from the inlets to the common outlet are identical to each other.

In accordance with exemplary embodiments, phase deviation between sets of acoustic signals that are output from respective acoustic drivers are reduced, and acoustic signals having large acoustic energy are output.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Embodiments will be hereinafter described in detail with reference to the drawings when necessary. Unduly detailed descriptions may be avoided; for example, detailed descriptions of already well-known items and repeated descriptions of substantially the same items may be omitted. This is to prevent the following description to become unduly redundant and to thereby facilitate understanding of those skilled in the art. The following description and the accompanying drawings are presented to allow those skilled in the art to understand the embodiments sufficiently and should not be construed as restricting the scope of the claims.

Speaker apparatuses according to embodiments are applied to, for example, speaker modules that are connected together to constitute a speaker array (array speaker). The speaker array may be used to implement a loudspeaker system that is installed in a wide area of, for example, an outdoor concert place and outputs acoustic signals having very large acoustic energy to enable listening by a large audience.

Embodiment 1

Figure 1:
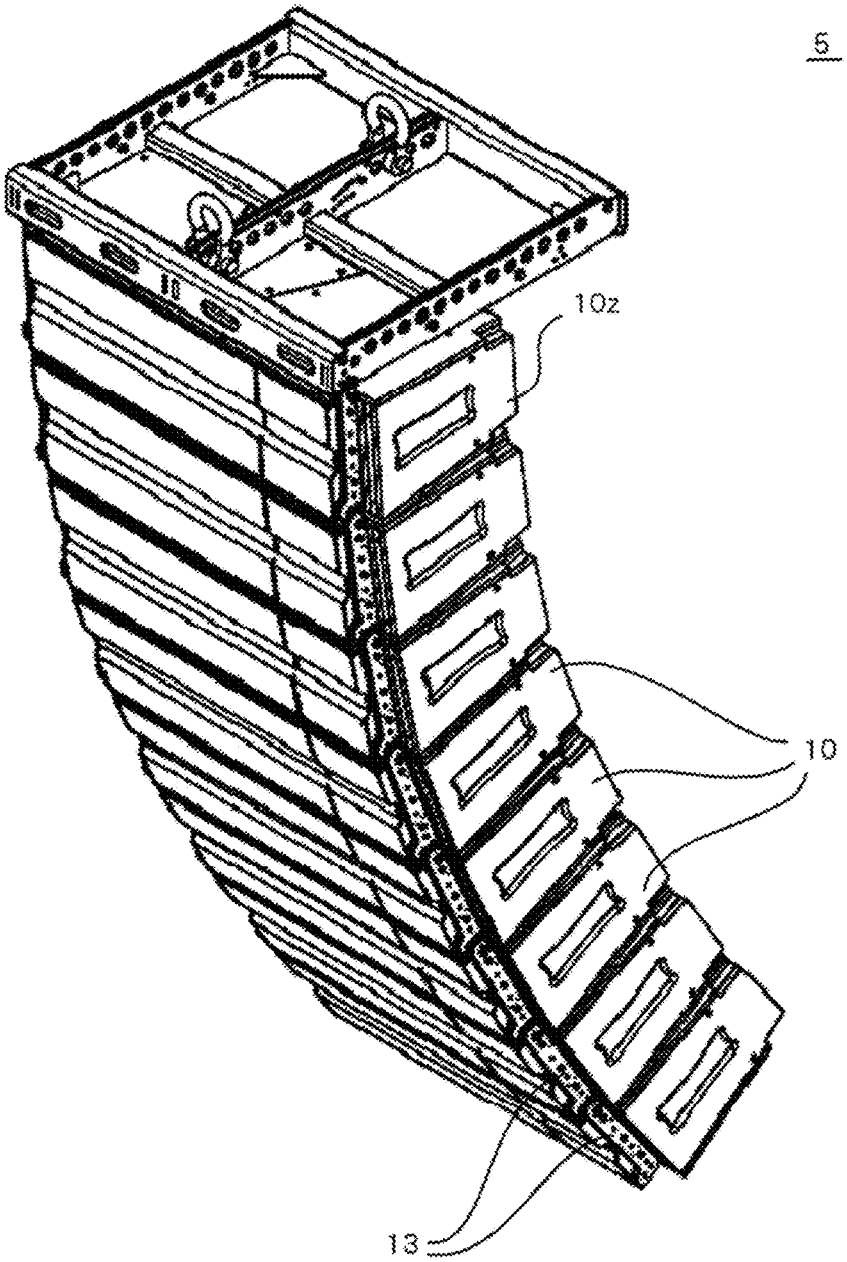
FIG. 1 shows an example appearance of a speaker array according to a first embodiment.

FIG. 1 shows an example appearance of a speaker array 5 according to a first embodiment. The speaker array 5 includes plural speaker modules 10 which are connected to each other to form a curved line. The top surface and the bottom surface of a case 10*z* of each speaker module 10 adjoins and is joined to the bottom surface of a case 10*z* of a speaker module 10 located above and the top surface of a case 10*z* of a speaker module 10 located below, respectively. The vertical range to be covered by the speaker array 5, that is, the vertical range in which acoustic signals that are output from the speaker array 5 are transmitted, is varied by changing the number of speaker modules 10 combined together to form a curved line. On the other hand, the horizontal dispersion angle of acoustic signals of the speaker array 5 is kept constant even if the number of speaker modules 10 combined together is changed.

To facilitate understanding of the description, with an assumption that the speaker array 5 is used being oriented vertically, a typical longitudinal direction of the speaker array 5 (i.e., the shorter-axis direction of the front surface of the case 10*z* of a representative speaker module 10) is employed as a vertical direction and the longitudinal direction of the front surface of the case 10*z* of the same speaker module 10, which is perpendicular to the above vertical direction, is employed as a horizontal direction. However, in actuality, the speaker array 5 may be set at any angle (e.g., it may be oriented horizontally). A surface in a side where acoustic signals are output may be referred to as a front surface.

As described later, the horizontal direction is an example of an arrangement direction of plural MF (medium-frequency)/HF (high-frequency) drivers that are connected to an acoustic coupler provided in each speaker module 10 and the vertical direction is an example of the direction that is perpendicular to the arrangement direction of the plural MF/HF drivers.

Figure 2A:
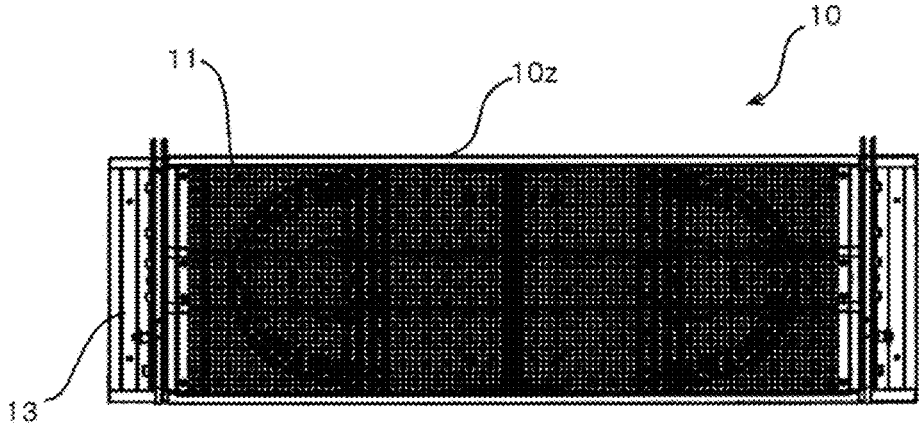
FIG. 2A is a front view showing an appearance of a speaker module.
Figure 2B:
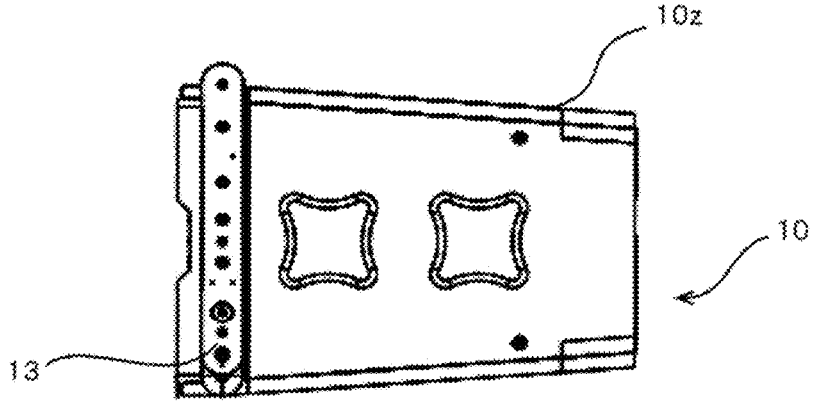
FIG. 2B is a side view of the speaker module.

FIGS. 2A and 2B are a front view and a side view, respectively, showing an appearance of each speaker module 10. The speaker module 10 has the case 10*z* which is substantially cuboid-shape. A water-repellent waterproof sheet 11 for preventing entrance of rain water etc. is disposed at the front of the case 10*z*. A grip 13 to be used for holding the speaker module 10 is attached to each of the side surfaces of the case 10*z* at a front position.

Figure 3:
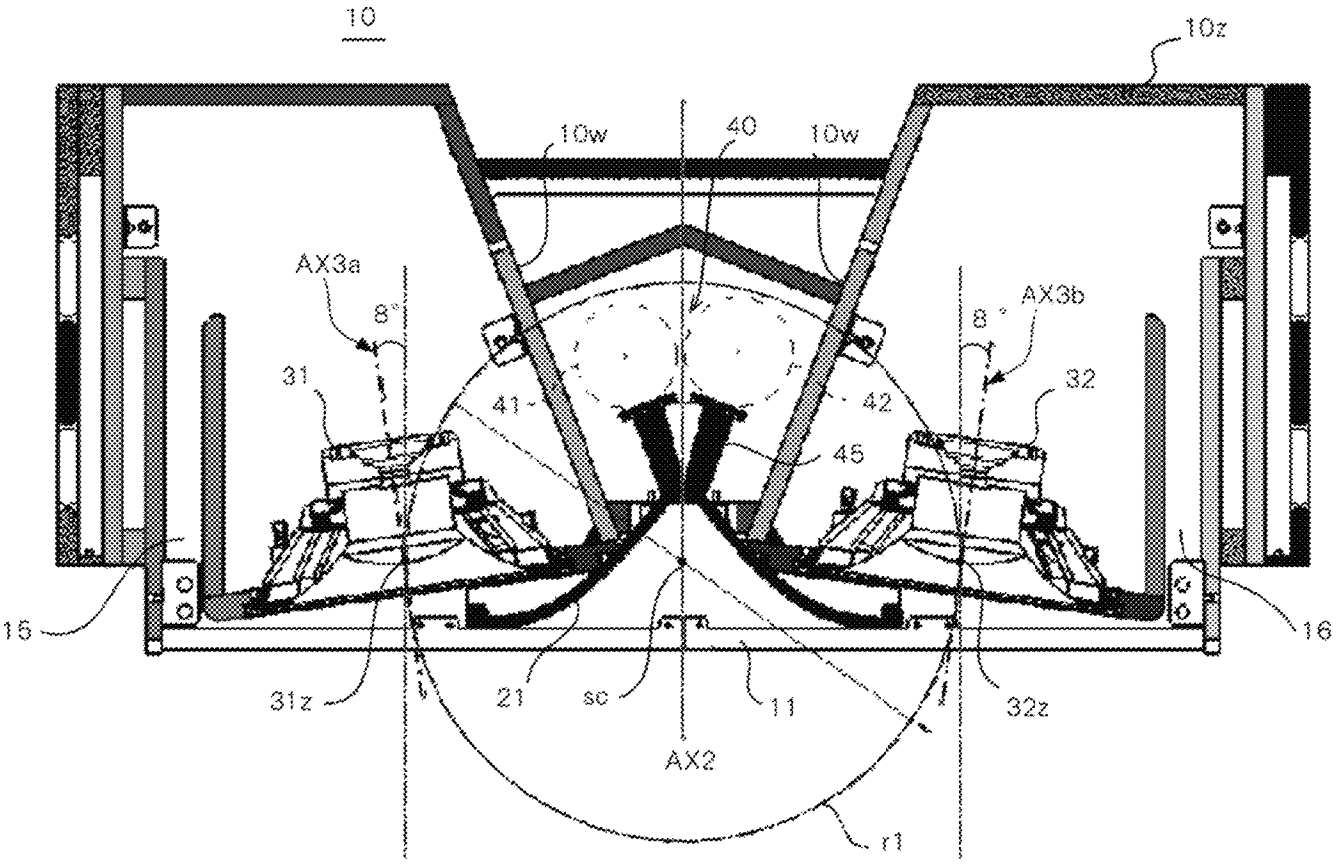
FIG. 3 is a sectional view showing an example configuration of the speaker module.

FIG. 3 is a sectional view showing an example configuration of the speaker module 10. More specifically, FIG. 3 is a sectional view of the speaker module 10 taken by a horizontal plane including the longitudinal direction of the case 10*z*. A waveguide (also called a horn) 21 is disposed at the center-front of the case 10*z*.

MF/HF driver units 40 are disposed in a rear of the waveguide 21 so as to be arranged in two stages in the vertical direction. For example, each MF/HF driver unit 40 has 1.75-inch HF (high-frequency) acoustic driver (HF driver) and a 3.5-inch MF (medium-frequency) acoustic driver (MF driver). Each MF/HF driver unit 40 outputs, forward of the case 10*z*, medium-frequency acoustic signals of 500 Hz to 6 kHz and high-frequency acoustic signals that are higher than 6 kHz. That is, each MF/HF driver unit 40 outputs acoustic signals in a middle/high-frequency range. Each MF/HF driver unit 40 will be described later in detail. The waveguide 21 diffuses, in the horizontal direction, acoustic signals that are output from the MF/HF driver units 40.

LF drivers 31 and 32 which are LF (low-frequency) acoustic drivers are disposed at the front of the case 10*z* on the two respective sides of the waveguide 21. The LF drivers 31 and 32, which are 12-inch acoustic drivers, for example, output, forward of the case 10*z*, low-frequency acoustic signals that are lower than or equal to 500 Hz. Low-frequency acoustic signals that are output from the LF drivers 31 and 32 are low in directivity and can partly be output from, for example, the back sides of the LF drivers 31 and 32. Although two LF drivers are provided in the embodiment, the number of LF drivers may be three or more.

Rear passages 15 and 16 are formed at the respective side ends of the case 10*z* on the front side using bass reflex ports BP. Communicating with the back sides of the LF drivers 31 and 32, respectively, the rear passages 15 and 16 guide low-frequency acoustic signals that are output from the back sides of the LF drivers 31 and 32 to front portions of the case 10*z*.

In the horizontal direction (left-right direction in FIG. 3), the two LF drivers 31 and 32 may be arranged symmetrically with respect to the MF/HF driver units 40. In this case, the center line of acoustic signals that are output from the speaker module 10 (acoustic center line) coincides with the acoustic center line of middle/high-frequency acoustic signals that are output from the MF/HF driver units 40. The acoustic center line of middle/high-frequency acoustic signals that are output from the MF/HF driver units 40 is shown as an imaginary axis AX2 in FIG. 3.

As shown in FIG. 3, an acoustic center position sc is set at a prescribed position on the acoustic center line of the speaker module 10. For example, the prescribed position is a position where the imaginary axis AX2 intersects a middle line of the waveguide 21.

The distance from the acoustic center position sc to each of output openings 31*z* and 32*z* of the LF drivers 31 and 32 may be determined on the basis of a frequency bandwidth of low-frequency acoustic signals. The difference between distances between a listening position (not shown) and the centers of output openings (e.g., output openings 31*z* and 32*z*) of two acoustic drivers (e.g., LF drivers 31 and 32) is called an acoustic centers distance (acoustic centers distance of the two acoustic drivers). That is, the acoustic centers distance of two acoustic drivers A and B is the difference between the distance A from the listening position to the center of the output opening of the acoustic driver A and the distance B from the listening position to the center of the output opening of the acoustic driver B. The listening position is a position of a listener who listens to acoustic signals that are output from the speaker module 10.

More specifically, where the frequency bandwidth of low-frequency acoustic signals is smaller than or equal to 500 Hz, the centers of the output openings 31*z* and 32*z* of the LF drivers 31 and 32 are set on a circle r1 around the acoustic center position sc having a radius 260 to 280 mm (e.g., 268 mm), for example. For example, where the frequency bandwidth of low-frequency acoustic signals is equal to 500 Hz, a phase deviation permissible range ¼×λ (a wavelength of low-frequency acoustic signals) is about 18 cm. Thus, the acoustic centers distance may be set using this value (18 cm) as a rough measure.

In general, when the phase deviation between two sets of acoustic signals is close to 180 degree, resulting acoustic signals tend to attenuate because of the opposite phases. On the other hand, when the phase deviation between two sets of acoustic signals is smaller than 90 degree (¼×λ), acoustic energy does not tend to attenuate. For low-frequency acoustic signals as described above, it is appropriate to dispose the LF drivers 31 and 32 (sound sources) in such a manner that the acoustic centers distance becomes shorter than about 20 cm (e.g., 18 cm). Even if the installation positions of the LF drivers 31 and 32 have some errors, a resulting phase deviation is small and hence have only little influence because of low-frequency acoustic signals.

As for the LF drivers 31 and 32, imaginary axes AX3 (AX3*a* and AX3*b*) which are acoustic center lines of low-frequency acoustic signals may be inclined by 8 degree with respect to the imaginary axis AX2 which is the acoustic center line of medium/high-frequency acoustic signals. That is, the LF drivers 31 and 32 may be installed so as to be inclined by 8 degree with respect to the imaginary axis AX2 in such directions that their output openings 31*z* and 32*z* come closer to each other. By inclining the output openings 31*z* and 32*z* of the LF drivers 31 and 32 inward in this manner, the output openings 31*z* and 32*z* come closer to each other (i.e., their distance becomes shorter) and hence their acoustic centers distance can be made shorter. As a result, the phase deviation between sets of low-frequency acoustic signals that are output from the respective LF drivers 31 and 32 can be reduced. The inclination angle (8 degree) may be determined according to the size of the case 10*z* and frequency bandwidth of acoustic signals.

The case 10*z* has partition walls 10*w* which separate the LF drivers 31 and 32 and the set of MF/HF driver units 40 from each other. With this measure, in the speaker module 10, a phenomenon can be suppressed that acoustic signals that are output from each acoustic driver (e.g., low-frequency acoustic signals) enter the space of another acoustic driver to cause interference between sets of acoustic signals there.

Figure 4:
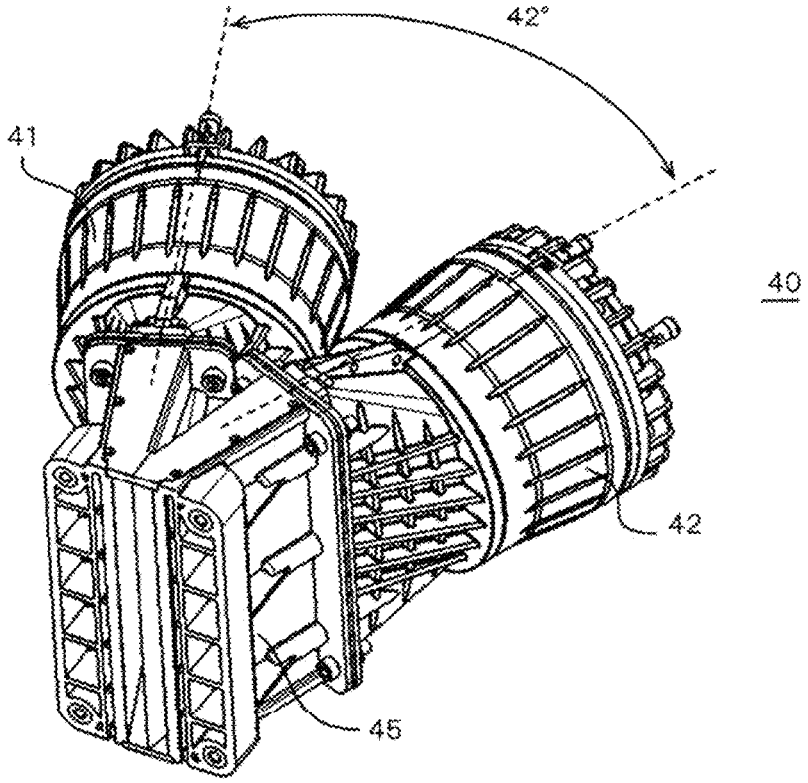
FIG. 4 is a perspective view showing an appearance of an MF/HF driver unit.

FIG. 4 is a perspective view showing an appearance of each MF/HF driver unit 40.

Each MF/HF driver unit 40 generates sets of medium/high-frequency acoustic signals, which are combined into a single set of medium/high-frequency acoustic signals. An acoustic center line along which this set of acoustic signals is transmitted is the imaginary axis AX2 (see FIG. 3).

Each MF/HF driver unit 40 is configured in such a manner that the two MF/HF drivers 41 and 42 are coupled to the acoustic coupler 45. Each of the MF/HF drivers 41 and 42 is a coaxial driver unit in which an MF driver and an HF driver are disposed coaxially.

In such coaxial driver units, for example, a voice coil of an MF plane wave driver is disposed around a voice coil of an HF plane wave driver. The HF voice coil and the MF voice coil are disposed coaxially, that is, their centers coincide with each other. Their centers are located on an acoustic center line of acoustic signals generated by the HF voice coil and acoustic signals generated by the MF voice coil.

Since the acoustic center line along which high-frequency acoustic signals are transmitted and the acoustic center line along which medium-frequency acoustic signals are transmitted coincide with each other, the high-frequency acoustic signals and the medium-frequency acoustic signals have no time difference and hence do not tend to suffer phase interference between them. In the embodiment, the high-frequency acoustic signals and the medium-frequency acoustic signals are output in phase from each of the MF/HF drivers 41 and 42.

Since the frequency ranges of sounds that are output from each MF/HF driver unit 40 include medium/high frequencies, phase deviation tends to occur unless the distance between the two MF/HF drivers 41 and 42 is set short. This is because phase deviation is more prone to occur as the frequency ranges of sets of acoustic signals increase (i.e., the wavelengths of the sets of acoustic signals become shorter). That is, as the frequency ranges of sets of acoustic signals become higher, their wavelengths become shorter and hence the values ¼×λ decrease. Thus, phase deviation tends to occur unless the distance between the two MF/HF drivers 41 and 42 is set short and positioned with respect to each other accurately.

Since the distance between the two MF/HF drivers 41 and 42 is set short, it is necessary to reduce their size, which however results in reduction of the power of acoustic signals that are output from each of the MF/HF drivers 41 and 42. In view of this, in the speaker module 10, a necessary power of acoustic signals is secured by employing plural pairs of MF/HF drivers 41 and 42.

Figure 5:
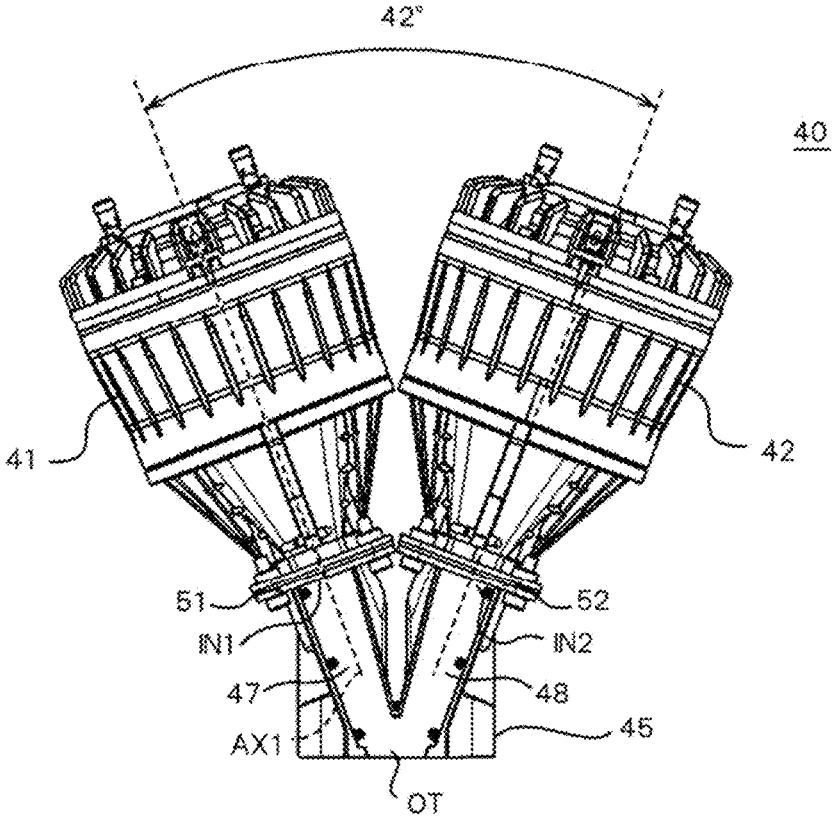
FIG. 5 is a partially sectional view showing a structure of a coupling portion of MF/HF drivers and an acoustic coupler.

FIG. 5 is a partially sectional view showing the structure of a coupling portion of the MF/HF drivers 41 and 42 and the acoustic coupler 45 of each MF/HF driver unit 40. Internal acoustic paths of the acoustic coupler 45 are shown in FIG. 5.

The acoustic coupler 45 is an acoustic pipe having acoustic passages 47 and 48 which are approximately V-shaped together. The acoustic coupler 45 guides, to a common outlet OT, medium/high acoustic signals that are output from the MF/HF drivers 41 and 42 which are connected to the end surfaces of attachment portions 51 and 52. The MF/HF drivers 41 and 42 are attached to the respective attachment portions 51 and 52. Two inlets IN1 and IN2 of the acoustic passages 47 and 48 are formed adjacent to the respective attachment portions 51 and 52. The acoustic coupler 45 combines two sets of medium/high acoustic signals at the common outlet OT and outputs resulting acoustic signals from it.

The two MF/HF drivers 41 and 42 are coupled to the acoustic coupler 45 so as to form, for example, an angle 41 degree to 43 degree (e.g., 42 degree (see FIG. 5)) in a horizontal plane and to attain in-phase coupling. Since the two MF/HF drivers 41 and 42 form an angle 41 degree to 43 degree in a horizontal plane, medium/high-frequency acoustic signals that are output from the respective MF/HF drivers 41 and 42 can be introduced into the acoustic coupler 45 while the MF/HF drivers 41 and 42 are not in contact with each other. Furthermore, since medium/high-frequency acoustic signals that are output from the respective MF/HF drivers 41 and 42 are in phase, the output power of medium/high-frequency acoustic signals can be increased, that is, the SPL (sound pressure level) can be increased.

Figure 6:
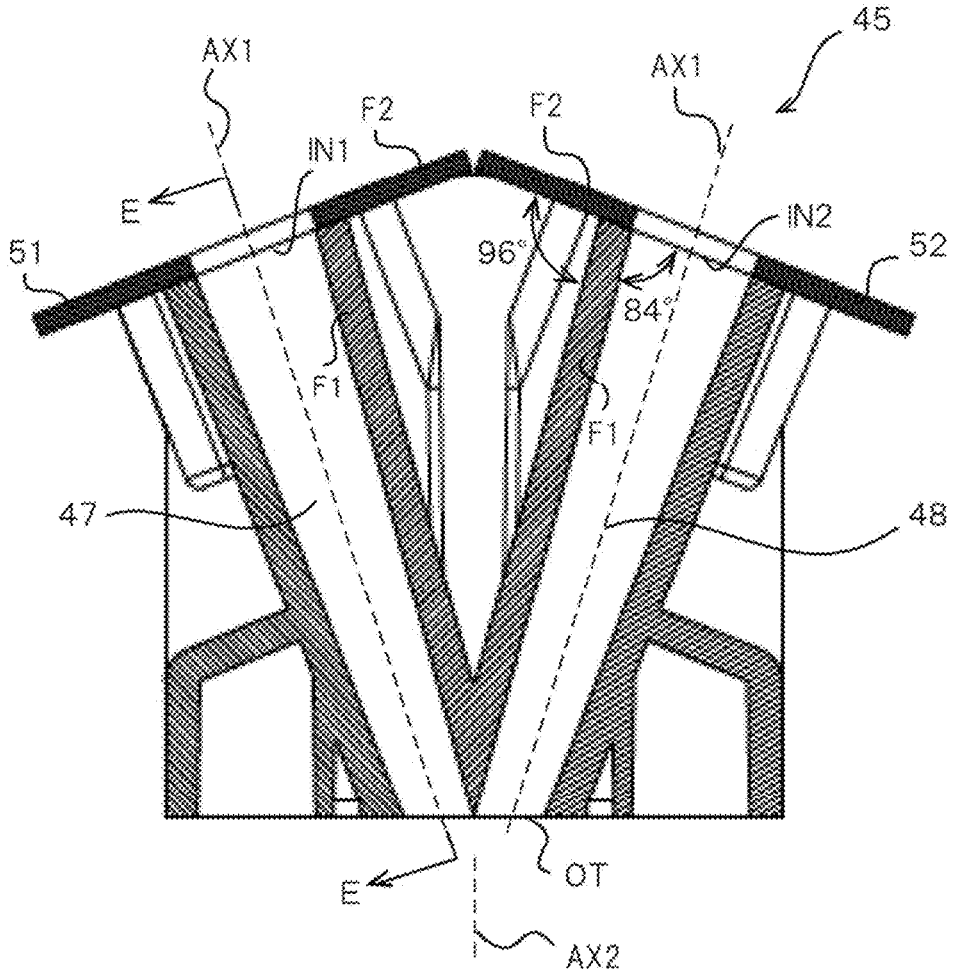
FIG. 6 is a sectional view showing a structure, in a horizontal plane, of the acoustic coupler.

FIG. 6 is a sectional view showing a structure, in a horizontal plane, of the acoustic coupler 45. In the horizontal plane, inside side walls F1 of the acoustic passages 47 and 48 form, for example, an angle 96 degree with walls F2, located outside the inlets IN1 and IN2, of the attachment portions 51 and 52, respectively. In other words, the inside side walls F1 of the acoustic passages 47 and 48 form, for example, an angle 84 degree with the inlets IN1 and IN2, that is, the openings of the attachment portions 51 and 52, respectively. Thus, the acoustic passages 47 and 48 narrow in a horizontal plane as the position come closer to the outlet OT. The distances of the acoustic passages 47 and 48 from the inlets IN1 and IN2 to the outlet OT are set identical.

With the above structure, two sets of medium/high-frequency acoustic signals that are output from the MF/HF drivers 41 and 42 travel through the acoustic passages 47 and 48 and are combined with each other and resulting medium/high-frequency acoustic signals are output from the outlet OT.

Figure 7:
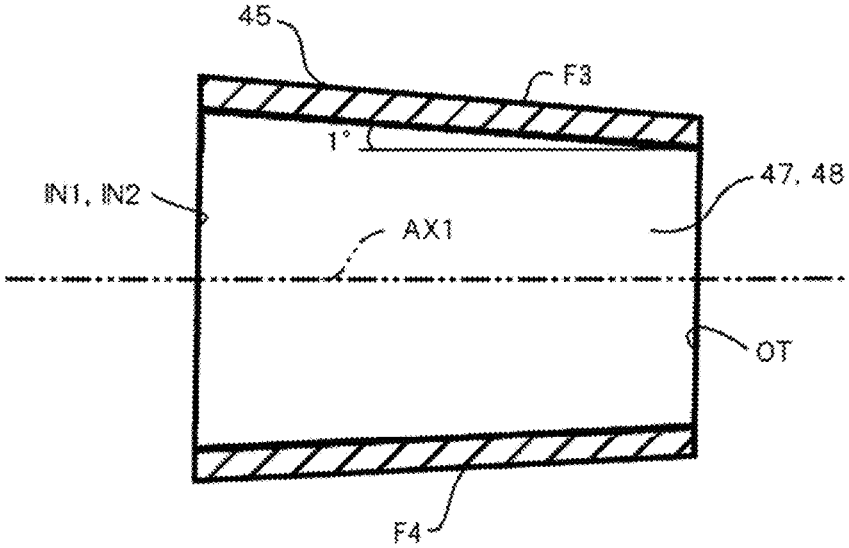
FIG. 7 is a sectional view showing a vertical sectional shape of an acoustic passage.

FIG. 7 is a sectional view showing a vertical sectional shape of each of the acoustic passages 47 and 48. A ceiling wall F3 and a bottom wall F4 of each of the acoustic passages 47 and 48 form, for example, an angle 1 degree with an imaginary axis AX1 which is an acoustic center line of sets of medium/high-frequency acoustic signals that are transmitted from the inlet IN1 or IN2 to the outlet OT. That is, each of the acoustic passages 47 and 48 narrows in the vertical direction as the position goes from the inlet IN1 or IN2 to the outlet OT.

Figure 8:
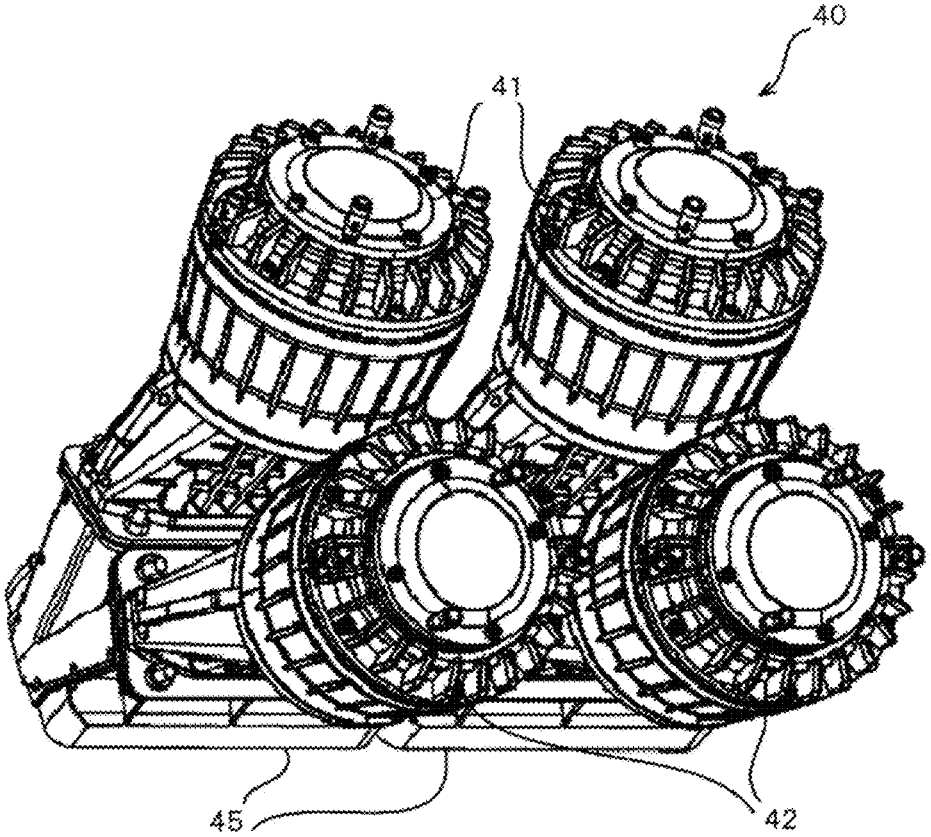
FIG. 8 is a perspective view, as viewed from a side of the MF/HF drivers, showing an appearance of two MF/HF driver units which are arranged adjacent to each other.
Figure 9:
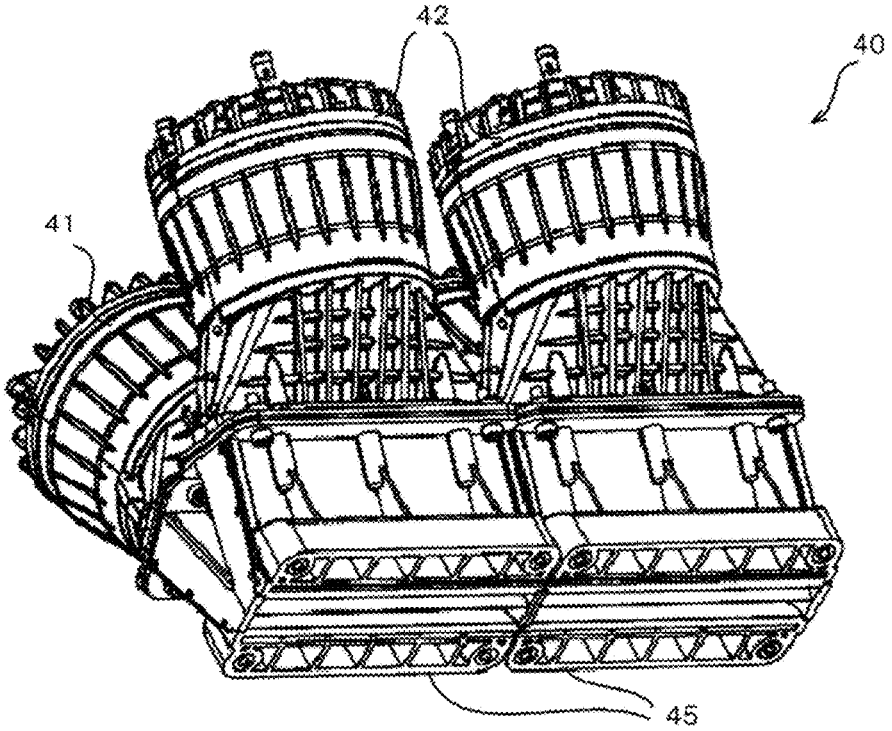
FIG. 9 is a perspective view, as viewed from a side of acoustic couplers, showing an appearance of the two MF/HF driver units which are arranged adjacent to each other.

The MF/HF driver units 40 are attached to the waveguide 21 so as to be arranged in two stages in the vertical direction. FIG. 8 is a perspective view, as viewed from the side of the MF/HF drivers 41 and 42, showing an appearance of the two MF/HF driver units 40 which are arranged adjacent to each other in the vertical direction. FIG. 9 is a perspective view, as viewed from the side of the acoustic couplers 45, showing an appearance of the two MF/HF driver units 40 which are arranged adjacent to each other in the vertical direction.

Since the two sets of MF/HF drivers 41 and 42, each set of MF/HF drivers 41 and 42 being arranged in the horizontal direction, are arranged in the vertical direction, the four acoustic drivers are serial/parallel-connected to each other in 2×2 matrix form. As a result, the power of acoustic signals generated is made four times the power of acoustic signals generated in a case of using a single acoustic driver. Furthermore, since the phase deviation between sets of acoustic signals that are output from each pair of MF/HF drivers 41 and 42 is reduced by the acoustic coupler 45, the speaker module 10 can suppress power reduction due to phase deviation while increasing the power of acoustic signals.

Although in the embodiment one acoustic coupler is coupled with each pair of acoustic drivers, one acoustic coupler may be coupled to four acoustic drivers that are serial/parallel-connected to each other.

In each MF/HF driver unit 40, the traveling directions of acoustic signals that are output from the MF/HF drivers 41 and 42 are restricted by the acoustic passages 47 and 48 and then the acoustic signals are output from the waveguide 21, whereby the directivity of acoustic signals that are output finally is determined. For example, for sets of acoustic signals that are output from the MF/HF drivers 41 and 42, the acoustic passages 47 and 48 are narrowed by 1 degree in the vertical direction as the position goes from the inlet IN1 or IN2 to the outlet OT. By virtue of this width narrowing, the directivity of acoustic signals that are output from the waveguide 21 falls within, for example, 10 degree or less in the vertical direction.

In the speaker module 10, a processor and amplifiers (neither shown) may be provided upstream of the MF/HF drivers 41 and 42. The processor separates an audio signal for sound output into frequency component signals which are, for example, a high-frequency audio signal (e.g., higher than or equal to 6 kHz), a medium frequency audio signal (e.g., 500 Hz to 6 kHz), and a low-frequency audio signal (e.g., lower than 500 Hz). Plural amplifiers may be provided for the respective frequency ranges, and the amplifiers amplify the sound pressure levels of the frequency component signals, respectively.

Figure 10A:
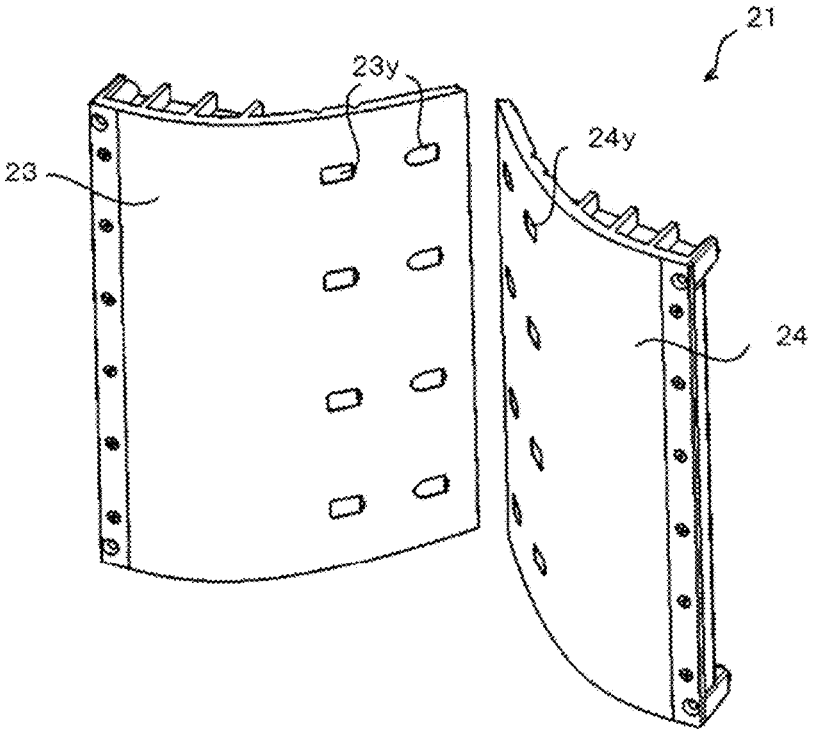
FIG. 10A is a perspective view showing an appearance of a waveguide.
Figure 10B:
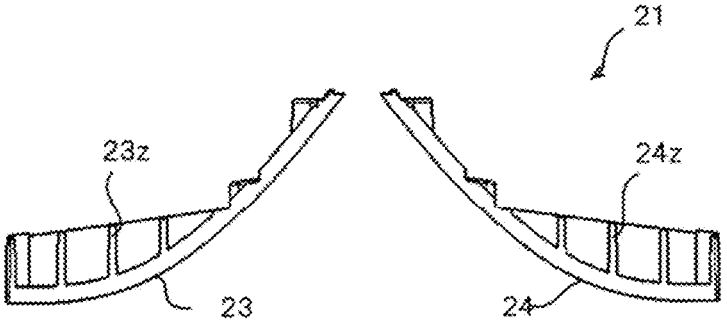
FIG. 10B is a top view of the waveguide.

FIG. 10A is a perspective view showing an appearance of the waveguide 21, and FIG. 10B is a top view of the waveguide 21.

The waveguide 21 has two curved resonance plates 23 and 24, as a result of which the waveguide 21 can secure prescribed horizontal directivity (e.g., 90 degree). In the speaker module 10, the space that is formed in front of the resonance plates 23 and 24 is narrow in a region close to the outlet OT of the acoustic coupler 45 and their horizontal aperture ratio (i.e., the interval between them) increases gradually as the position goes forward in the acoustic signal traveling direction from the outlet OT of the acoustic coupler 45.

The space between the resonance plates 23 and 24 serves for input of acoustic signals that are output from the MF/HF driver units 40 disposed in the rear of the waveguide 21 and for output of acoustic signals that are output from the waveguide 21 while being diffused in the horizontal direction.

Ribs 23*z* and 24*z* may project rearward from the respective resonance plates 23 and 24. The Ribs 23*z* and 24*z* can reinforce the waveguide 21 and suppress generation of unintended vibration due to the pressure of acoustic signals.

Each of the resonance plates 23 and 24 is formed with, for example, eight screw holes 23*y* or 24*y* to be used for fixing the waveguide 21 to the case 10*z* of the speaker module 10 with screws.

The LF drivers 31 and 32 are attached to the back surfaces of the resonance plates 23 and 24 at positions that are spaced from each other in the horizontal direction. In the speaker module 10, since the waveguide 21 is fixed to the case 10*z*, generation of an unexpected sound due to acoustic signals can be suppressed.

The waveguide 21 can change the output pattern of acoustic signals in the horizontal direction through adjustment of the aperture ratio using the resonance plates 23 and 24. For example, with the waveguide 21, the horizontal directivity angle may be set at an angle other than 90 degree and the output pattern may be made unsymmetrical with respect to the imaginary axis AX2. The degree of contribution of the waveguide 21 to the directivity in the vertical direction is low; the shapes of the acoustic passages 47 and 48 in the acoustic coupler 45 have great contribution to it.

Next, acoustic characteristics of each MF/HF driver unit 40 will be described.

Figure 11A:
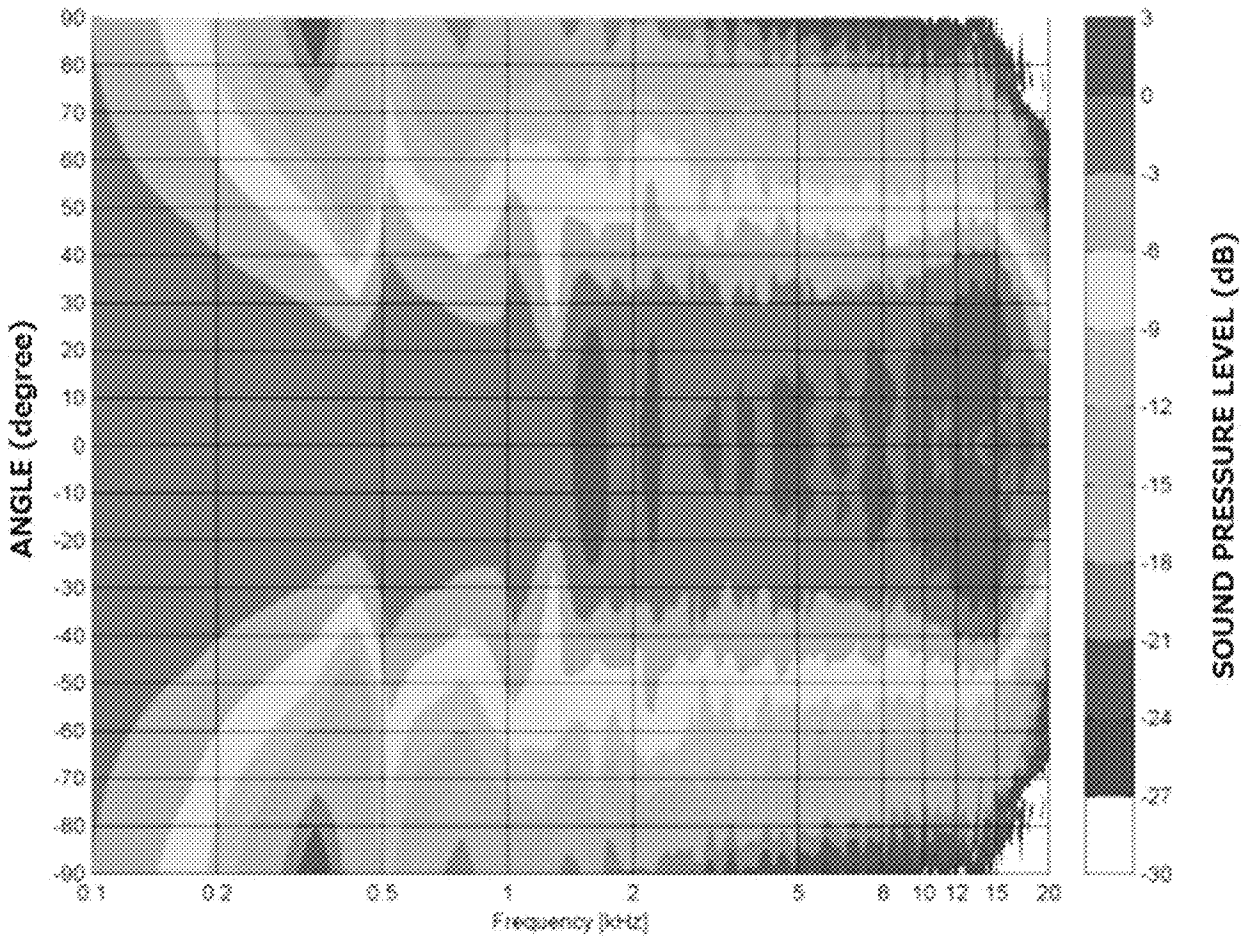
FIG. 11A is a sound pressure level distribution diagram in the horizontal direction of an MF/HF driver unit.
Figure 11B:
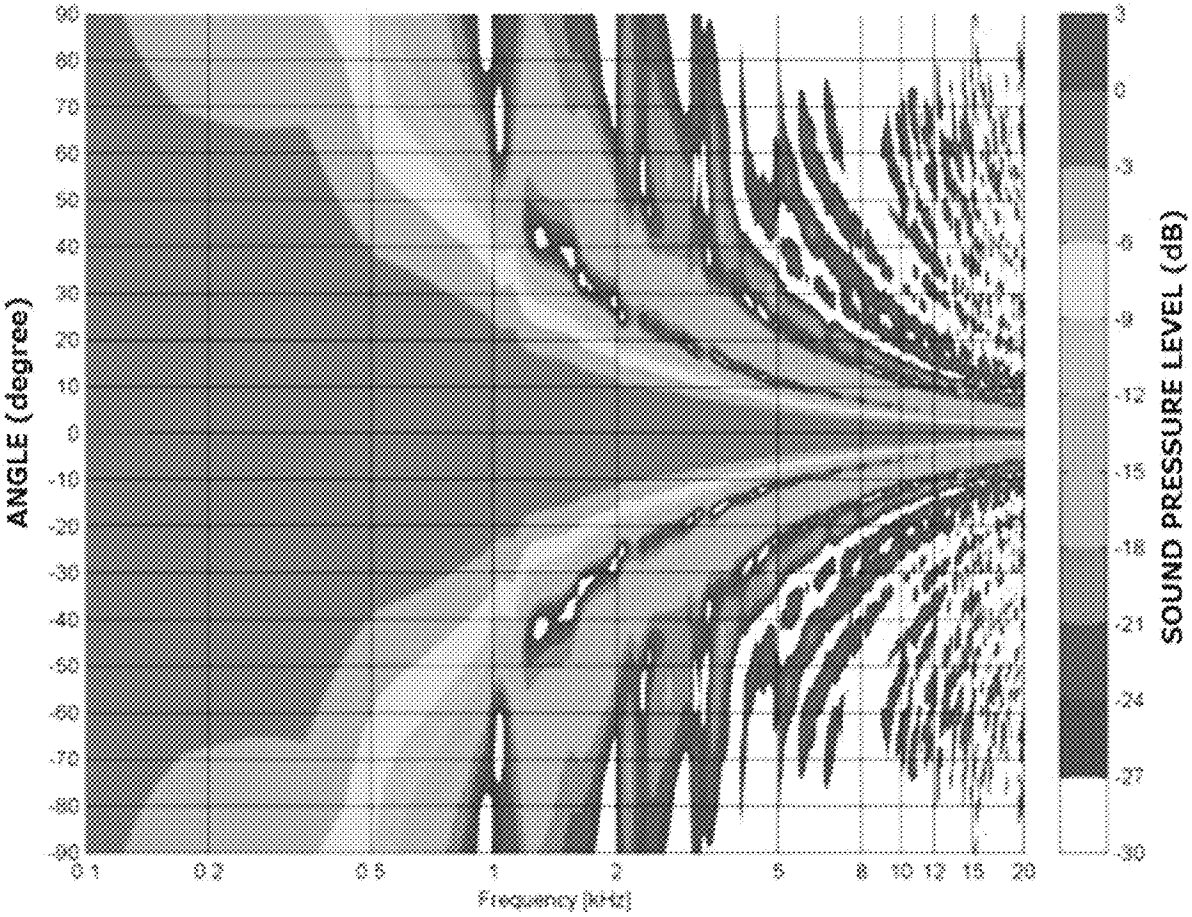
FIG. 11B is a sound pressure level distribution diagram in the vertical direction of the MF/HF driver unit.

FIG. 11A is a distribution diagram of the sound pressure level of acoustic signals that are output from each MF/HF driver unit 40 in which the horizontal directivity direction and the frequency are variables. FIG. 11B is a distribution diagram of the sound pressure level of acoustic signals that are output from each MF/HF driver unit 40 in which the vertical directivity direction and the frequency are variables. FIGS. 11A and 11B show simulation results.

In FIGS. 11A and 11B, the horizontal axis represents the frequency. The left-hand vertical axis represents the angle of measurement points corresponding to a certain point on the imaginary axis AX2 which is the acoustic center line of acoustic signals that are output from each MF/HF driver unit 40. The right-hand vertical axis represents the sound pressure level of acoustic signals that are output from the speaker module 10 at the frequency on the horizontal axis.

The distances from the certain point on the imaginary axis AX2 to each set of measurement points are set identical (e.g., 1 m, 3 m, or 6 m in radius). Microphones may be set at the respective measurement points to measure sound pressure levels. The measurement points are set in the horizontal plane in the case of FIG. 11A and in the vertical plane in the case of FIG. 11B.

Figure 11C:
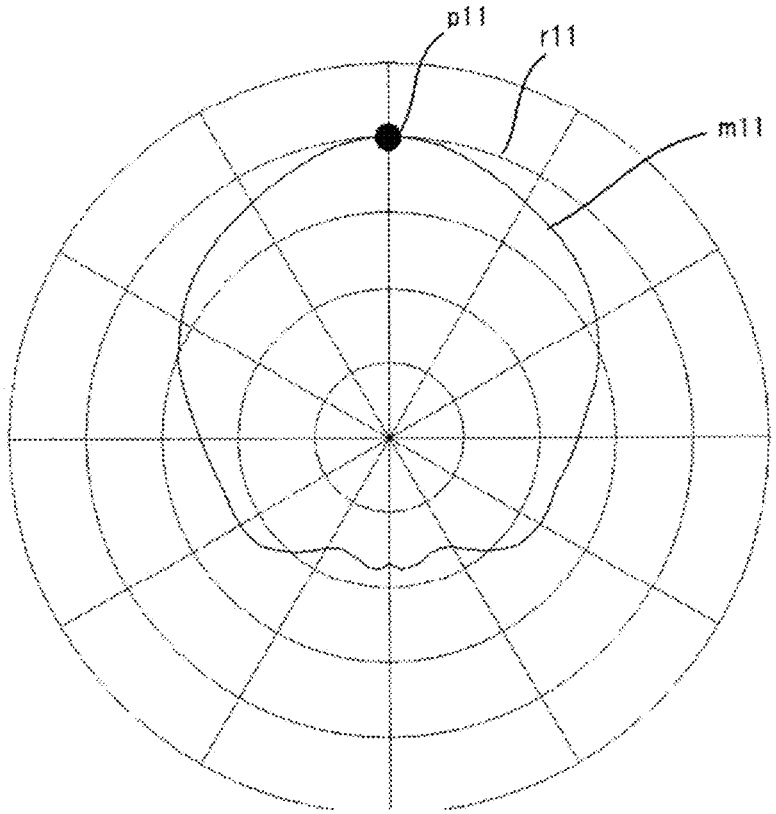
FIG. 11C shows a specific example of a relationship between a measurement point angle and a sound pressure level (relative value) in the horizontal plane.
Figure 11D:
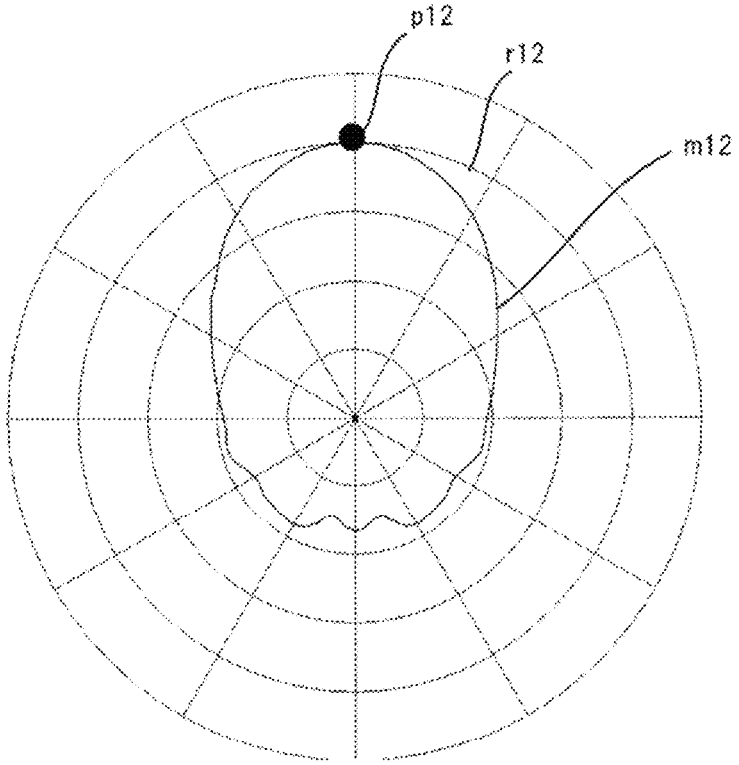
FIG. 11D shows a specific example of a relationship between a measurement point angle and a sound pressure level (relative value) in the vertical plane.

FIGS. 11C and 11D shows specific examples of relationships between the measurement point angle and the sound pressure level (relative value).

In FIG. 11C, the centers of circles are the same point which is the above-mentioned prescribed point on the imaginary line AX2. A point p11 on a circle r11 represents a sound pressure level corresponding to the prescribed point on the imaginary line AX2. This sound pressure level is a reference level (0 dB). If a sound pressure level at a measurement point on the circle r11 is plotted on the circle r11, the sound pressure level is 0 dB. If a sound pressure level at a measurement point on the circle r11 is plotted inside the circle r11, the sound pressure level is lower than 0 dB (attenuated). A curve m11 is obtained when sound pressure level measurement results at the respective points on the circle r11.

In FIG. 11C, plural circles having different radii are shown and the difference between the radii of adjacent circles corresponds to 10 dB (i.e., one division corresponds to 10 dB). It is seen from FIG. 11C that attenuation of 6 dB (−6 dB) occurs at the measurement points of, for example, 50 degree (an angle with respect to the traveling direction of acoustic signals (upward in FIG. 11C)).

Whereas the measurement example of FIG. 11C corresponds to a case that the frequency of acoustic signals is 1 kHz, FIG. 11A shows a result of a measurement in which sound pressure levels were measured at each measurement point while the frequency of acoustic signals was varied. The frequency of acoustic signals may be varied so as to include 125 Hz, 250 Hz, 500 Hz, 1 kHz, 2 kHz, and 4 kHz, for example.

Likewise, in FIG. 11D, the centers of circles are the same point which is the above-mentioned prescribed point on the imaginary line AX2. A point p12 on a circle r12 represents a sound pressure level corresponding to the prescribed point on the imaginary line AX2. This sound pressure level is a reference level (0 dB). If a sound pressure level at a measurement point on the circle r12 is plotted on the circle r12, the sound pressure level is 0 dB. If a sound pressure level at a measurement point on the circle r12 is plotted inside the circle r12, the sound pressure level is lower than 0 dB (attenuated). A curve m12 is obtained when sound pressure level measurement results at the respective points on the circle r12.

In FIG. 11D, plural circles having different radii are shown and the difference between the radii of adjacent circles corresponds to 10 dB (i.e., one division corresponds to 10 dB). It is seen from FIG. 11D that attenuation of 6 dB (−6 dB) occurs at the measurement points of, for example, 35 degree (an angle with respect to the traveling direction of acoustic signals (upward in FIG. 11C)).

Whereas the measurement example of FIG. 11D corresponds to a case that the frequency of acoustic signals is 1 kHz, FIG. 11B shows a result of a measurement in which sound pressure levels were measured at each measurement point while the frequency of acoustic signals was varied. The frequency of acoustic signals may be varied so as to include 125 Hz, 250 Hz, 500 Hz, 1 kHz, 2 kHz, and 4 kHz, for example.

In FIGS. 11A and 11B, sound pressure levels are shown in the form of color gradation. In FIGS. 11A and 11B, regions of high sound pressure levels (close to 3 dB, for example) and drawn in colors including a red component. On the other hand, regions of low sound pressure levels (close to −30 dB, for example) and drawn in colors including a blue component. For example, sound pressure levels of ranges from 3 dB to −30 dB are represented by a reddish color, a yellowish color, a greenish color, a bluish color, a purplish color, and white (lowest sound pressure level) in this order.

In FIG. 11A, when the frequency is 125 Hz, the sound pressure level is higher than or equal to −6 dB at any angle. When the frequency is 250 Hz, the sound pressure level is approximately equal to −6 dB around an angle 50 degree. When the frequency is 500 Hz, the sound pressure level is approximately equal to −6 dB around an angle 50 degree. When the frequency is 1 kHz, the sound pressure level is approximately equal to −6 dB around an angle 50 degree. When the frequency is 2 kHz, the sound pressure level is approximately equal to −6 dB around an angle 48 degree. When the frequency is 4 kHz, the sound pressure level is approximately equal to −6 dB around an angle 48 degree. Basically, a high sound pressure level is obtained in a wider angular range when the frequency is lower. In a frequency range that is higher than 500 Hz, the relationship between the sound pressure level and the angle is approximately the same. The sound pressure level lowers as the angle increases.

In FIG. 11B, when the frequency is 125 Hz, the sound pressure level is higher than or equal to −6 dB at any angle. When the frequency is 250 Hz, the sound pressure level is higher than or equal to −6 dB at any angle. When the frequency is 500 Hz, the sound pressure level is approximately equal to −6 dB around an angle 60 degree. When the frequency is 1 kHz, the sound pressure level is approximately equal to −6 dB around an angle 35 degree. When the frequency is 2 kHz, the sound pressure level is approximately equal to −6 dB around an angle 15 degree. When the frequency is 4 kHz, the sound pressure level is approximately equal to −6 dB around an angle 10 degree. Basically, a high sound pressure level is obtained in a wider angular range when the frequency is lower. The angular range where the same sound pressure level is obtained narrows as the frequency increases. The sound pressure level lowers as the angle increases.

In FIG. 11A, in the entire frequency range that is higher than or equal to 500 Hz, the horizontal angular range where the sound pressure level is relatively high (e.g., higher than or equal to −6 dB) includes the range of ±45 degree. That is, each MF/HF driver unit 40 can always provide acoustic signals having high sound pressure levels in the horizontal directivity angle range of about 90 degree.

As shown in FIG. 11B, in the frequency range between 500 Hz to 4 KHz, there are portions in which the vertical angular range where the sound pressure level is relatively high (e.g., higher than or equal to −6 dB) is expanded over the range of ±5 degree. An interference of acoustic signals between MF/HF driver units 40 depends on a distance between the MF/HF driver units 40. It is similar that a phase deviation is occurred depending on a distance between the LF drivers 31, 32. However, according to the embodiment, the two MF/HF driver units 40 are closely arranged (as shown in FIGS. 8 and 9), the distance between MF/HF driver units 40 is within a permissible range of the phase deviation in the frequency range of under 4 KHz. Accordingly, in the frequency range of 500 Hz to 4 KHz, even if the vertical angular range is not within the range of ±5 degree, an influence to the phase deviation is small.

A frequency range where an influence to the phase deviation starts to increase is the frequency range of approximately 4 KHz. As shown in FIG. 11B, in a frequency range over approximately 4 KHz, the vertical angular range where the sound pressure level is relatively high (e.g., higher than or equal to −6 dB) is within the range of ±5 degree. That is, the interference between adjacent MF/HF driver units 40 is small. Accordingly, the MF/HF driver units 40 provide acoustic signals in which a sound pressure level in the vertical direction is high and the phase deviation is small, in the frequency range over 500 Hz, in a range that vertical directivity angle is within 10 degree.

In each of FIGS. 11A and 11B, the directivity lowers as the frequency decreases. In a very low frequency range, acoustic signals are transmitted while keeping a high sound pressure level at any horizontal or vertical angle.

It is seen from FIG. 11B that the vertical directivity angle range narrows as the frequency increases.

In a high-frequency range of the distribution diagram of FIG. 11B, the sound pressure level does not increase discontinuously in angular regions where the sound pressure level is low. This means that side lobes of acoustic signals are minimized in the vertical direction and the quality of the acoustic signals is thus high. As a result, in the speaker array 5 which is configured by connecting speaker modules 10 in the vertical direction, the degree of disorder of side lobes can be made low and increase of phase interference can be suppressed. The same is true in the horizontal direction.

Figure 12A:
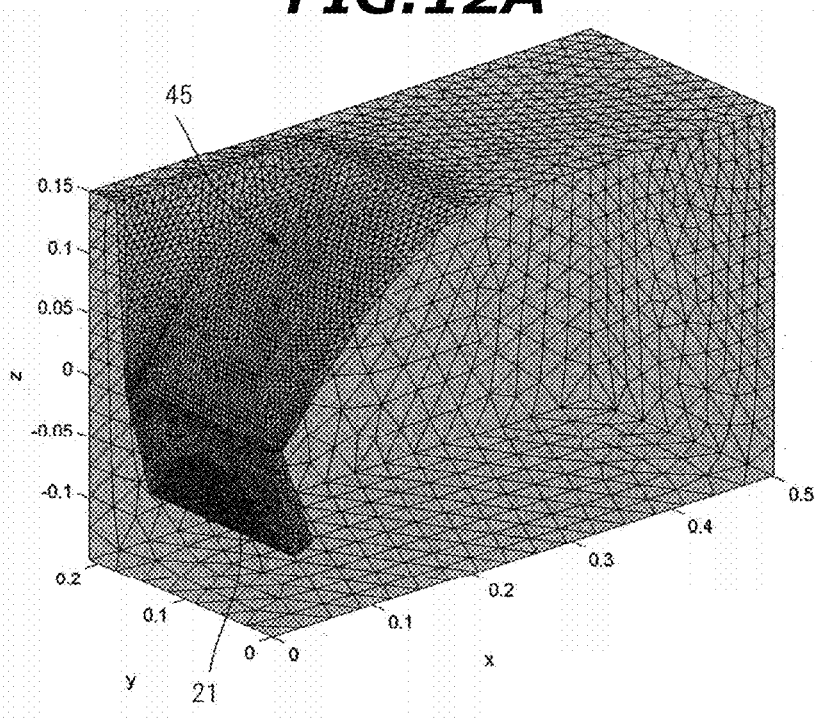
FIG. 12A is a diagram showing, in mesh form, three-dimensional positions from the acoustic coupler to the waveguide where a horizontal directivity characteristic is measured.
Figure 12B:
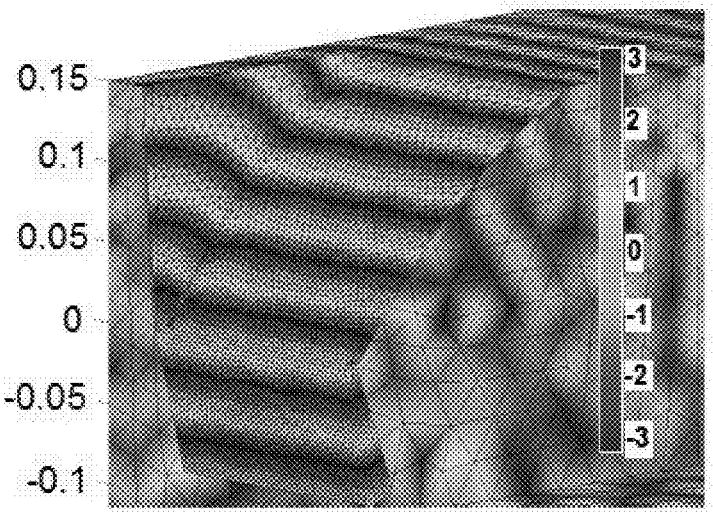
FIG. 12B is a distribution diagram showing phase characteristics at respective three-dimensional positions.

FIG. 12A is a diagram showing, in mesh form, three-dimensional positions from the acoustic coupler 45 to the waveguide 21 where a horizontal directivity characteristic is measured. FIG. 12B is a distribution diagram showing, in the form of color gradation, horizontal phase characteristics at respective three-dimensional positions from the acoustic coupler 45 to the waveguide 21.

As shown in FIG. 12B, stripe patterns that repeat at a constant interval are produced by the acoustic coupler 45 and the waveguide 21 in the range that is surrounded by the resonance plates 23 and 24 of the waveguide 21. It is therefore understood that acoustic signals that pass through the acoustic coupler 45 and acoustic signals that are output from the outlet OT of the acoustic coupler 45 are both small in phase deviation.

Figure 13:
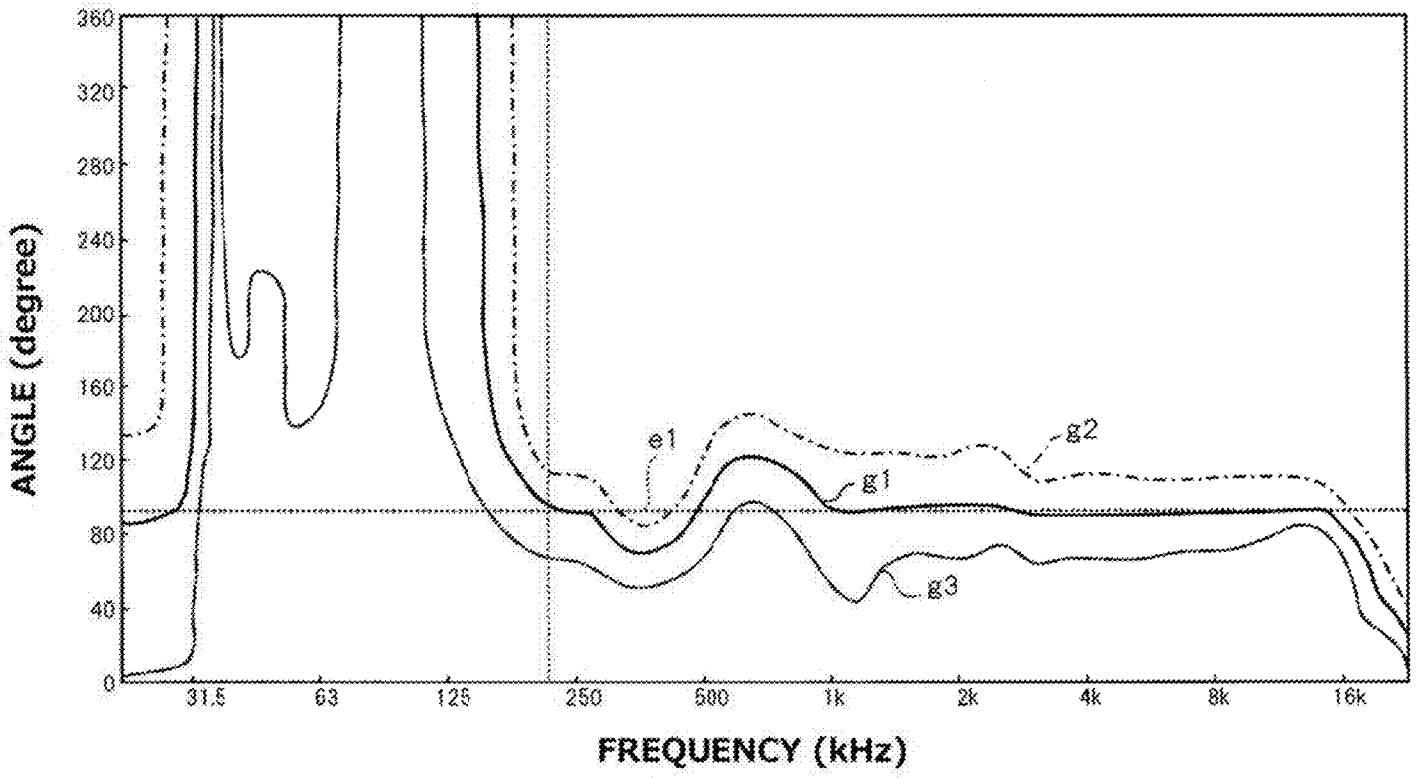
FIG. 13 is a graph showing a relationship between frequency and horizontal directivity angle (measured value) of acoustic signals that are output from an MF/HF driver unit.

FIG. 13 is a graph showing a relationship between the frequency and the horizontal directivity angle (measured value) of acoustic signals that are output from each MF/HF driver unit 40 employed in the embodiment. The horizontal axis and the vertical axis represent the frequency and the horizontal directivity angle of acoustic signals, respectively.

In FIG. 13, a broken line e1 indicates an ideal characteristic that the horizontal directivity angle is kept at 90 degree over the entire frequency range. Sound pressure levels of acoustic signals were measured by the same method as in the case of FIG. 11A. Each horizontal directivity angle value shown in FIG. 13 was calculated on the basis of sound pressure levels measured at the respective measurement points.

Curve g1 is a −6 dB contour line obtained by connecting horizontal directivity angles (calculated at the respective frequencies) at which a sound pressure level −6 dB was obtained. That is, curve g1 is a −6 dB contour line obtained by connecting angles (calculated at the respective frequencies) each of which was calculated from positions of 6 dB attenuation from a sound pressure level on the acoustic center line (which coincides with the imaginary axis AX2) of the MF/HF driver unit 40. Likewise, curve g2 is a −3 dB contour line obtained by connecting horizontal directivity angles (calculated at the respective frequencies) at which a sound pressure level −3 dB was obtained. Curve g3 is a −9 dB contour line obtained by connecting horizontal directivity angles (calculated at the respective frequencies) at which a sound pressure level −9 dB was obtained.

In FIG. 13, curve g1 (−6 dB contour line) approximately coincides with the broken-line curve e1 (ideal characteristic) in a frequency range of 200 Hz to 10 kHz. This coincidence occurs at the horizontal directivity angle 90 degree. Thus, in the speaker module 10, by making adjustments so that acoustic signals are output from the waveguide 21 in an angular range of 90 degree, the acoustic signals can be radiated with reduced loss of acoustic energy.

Figure 14A:
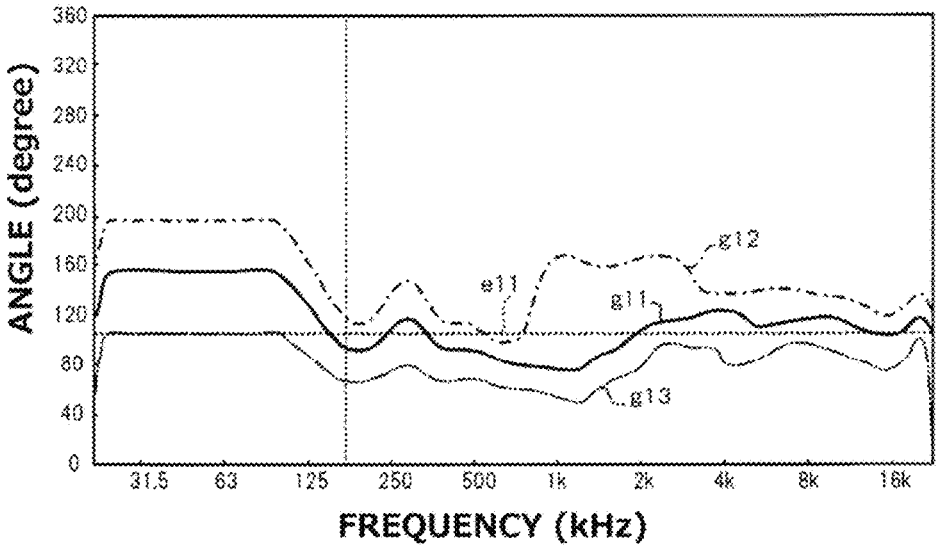
FIG. 14A is a graph showing a relationship between frequency and horizontal directivity angle (measured value) of acoustic signals that are output from acoustic drivers of Comparative Example 1.
Figure 14B:
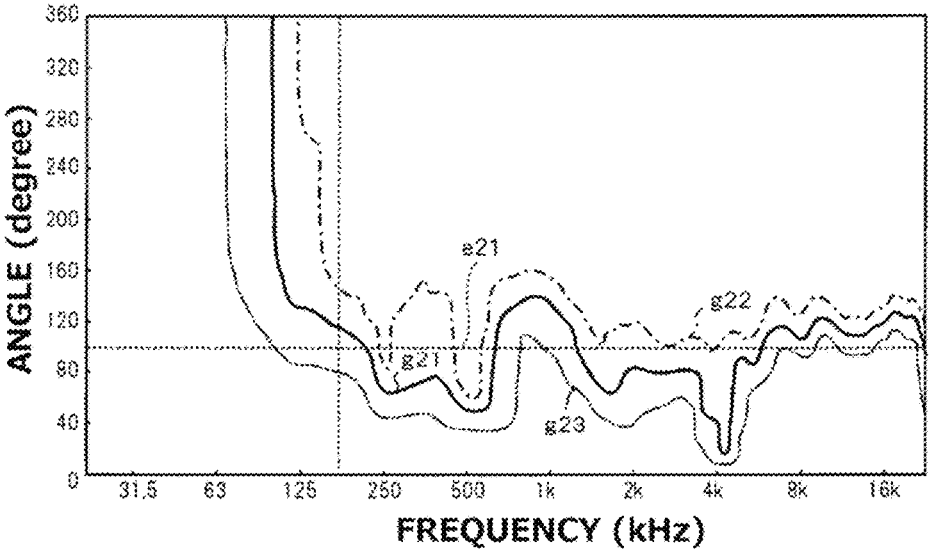
FIG. 14B is a graph showing a relationship between frequency and horizontal directivity angle (measured value) of acoustic signals that are output from acoustic drivers of Comparative Example 2.

FIG. 14A is a graph showing a relationship between the frequency and the horizontal directivity angle (measured value) of acoustic signals that are output from an acoustic driver of Comparative Example 1. The horizontal axis represents the frequency of acoustic signals and the vertical axis represents the horizontal directivity angle. Likewise, FIG. 14B is a graph showing a relationship between the frequency and the horizontal directivity angle (measured value) of acoustic signals that are output from an acoustic driver of Comparative Example 2. The horizontal axis represent the frequency of acoustic signals and the vertical axis represents the horizontal directivity angle.

In FIG. 14A, a broken line ell indicates an ideal characteristic. Curves g11, g12, and g13 are a −6 dB contour line, a −9 dB contour line, and a −3 dB contour line, respectively. In FIG. 14B, a broken line e21 indicates an ideal characteristic. Curves g21, g22, and g23 are a −6 dB contour line, a −9 dB contour line, and a −3 dB contour line, respectively.

Configurations of Comparative Examples 1 and 2 are different from the configuration of the first embodiment. The systems of Comparative Examples 1 and 2 have no MF/HF driver units 40 and no acoustic coupler 45. That is, in the systems of Comparative Examples 1 and 2, there are no care about lengths and angles of acoustic passages. In contrast, according to the first embodiment, the MF/HF driver units 40 have the acoustic couplers 45 and the acoustic passages 47, 48 are devised in their lengths and angles.

Accordingly, in the speaker module 10 according to the embodiment, the −6 dB contour curve is closer to the ideal characteristic than in Comparative Examples 1 and 2. It is therefore understood that in the embodiment the state that the horizontal directivity angle is close to 90 degree and in which large acoustic energy can be obtained can be kept in the frequency range of 200 Hz to 10 kHz more precisely than in Comparative Examples 1 and 2. In the speaker module 10, by making adjustments so that acoustic signals are output from the waveguide 21 at an angle 90 degree, the acoustic signals can be radiated with reduced loss of acoustic energy.

Figure 15:
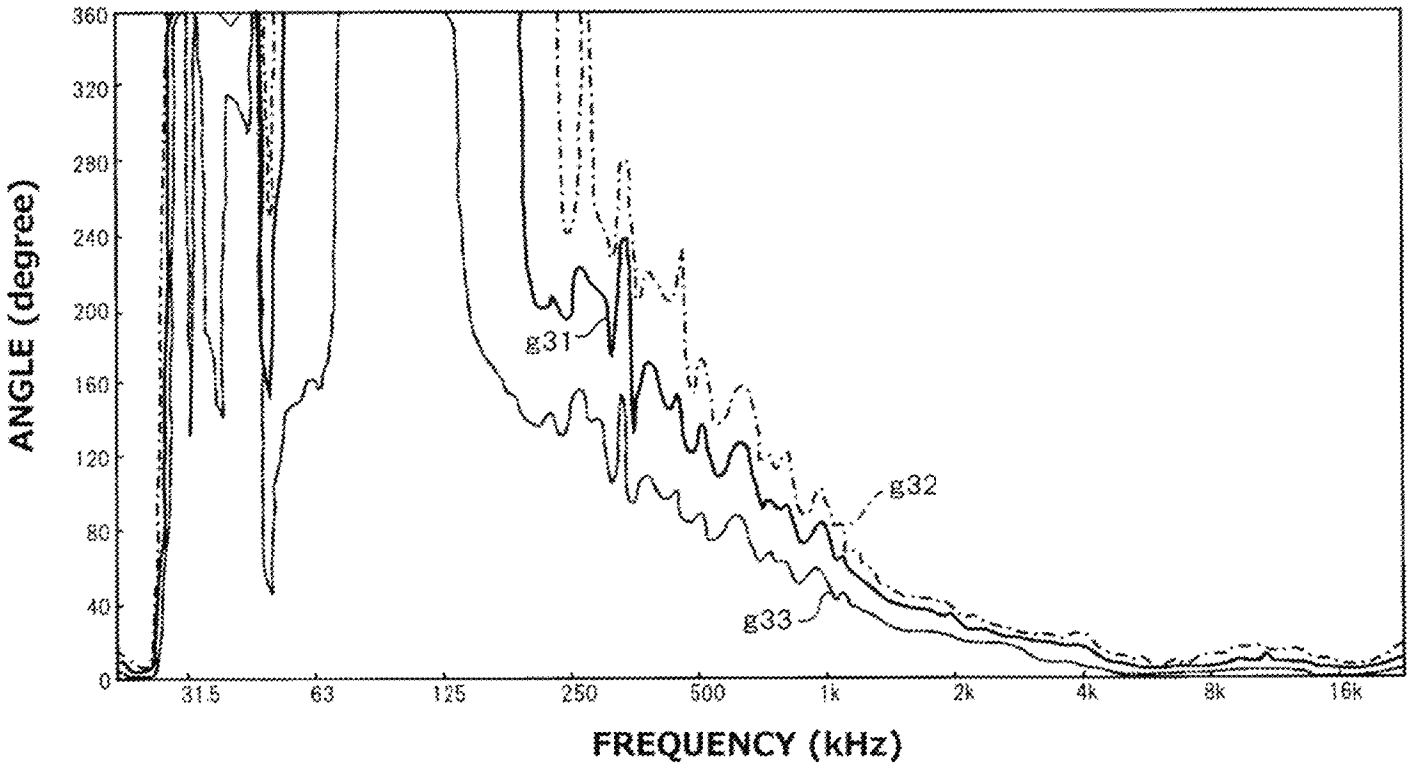
FIG. 15 is a graph showing a relationship between frequency and vertical directivity angle (measured value) of acoustic signals that are output from MF/HF driver unit.

FIG. 15 is a graph showing a relationship between the frequency and the vertical directivity angle (measured value) of acoustic signals that are output from each MF/HF driver unit 40 employed in the embodiment. The horizontal axis and the vertical axis represent the frequency and the vertical directivity angle of acoustic signals, respectively.

Sound pressure levels of acoustic signals were measured by the same method as in the case of FIG. 11B. Each vertical directivity angle value shown in FIG. 15 was calculated on the basis of sound pressure levels measured at the respective measurement points.

In FIG. 15, curves g31, g32, and g33 are a −6 dB contour line, a −9 dB contour line, and a −3 dB contour line, respectively. The −6 dB contour curve g31 shown in FIG. 15 is such that the vertical directivity angle decreases gradually as the frequency increases in a frequency range of 500 Hz to 6 kHz and has an approximately constant value of 10 degree in an even higher frequency range.

As described above, in the speaker module 10, the acoustic centers distance of each pair of acoustic drivers is set short, whereby a good phase characteristic can be realized. Since the speaker module 10 is equipped with the waveguide 21 having a curvature that realizes proper horizontal directivity, constant horizontal directivity can be realized in a medium and higher frequency range. As such, the speaker module 10 can provide acoustic characteristics that is uniform and low in the degree of phase disorder in angular ranges covered (e.g., smaller than or equal to 90 degree in the horizontal direction and smaller than or equal to 10 degree in the vertical direction. A shape of the waveguide 21 having a curvature as described above may be derived according to a prescribed function, for example.

In the speaker module 10, since the plural MF/HF drivers 41 and 42 are coupled accurately to the acoustic coupler 45, the vertical directivity angle can be made smaller than or equal to 10 degree, for example, and high power handling (e.g., 600 W in an MF range and 300 W in an HF range) can be attained.

In the speaker module 10, since the coaxial MF/HF drivers 41 and 42 are employed, the acoustic centers distances of the MF drivers and the HF drivers are reduced to the minimum value 0 and hence phase deviation can be minimized. As a result, unlike the loudspeaker disclosed in Patent document 1, the speaker module 10 does not require separation members for frequency range separation.

The speaker array 5 may be constructed by connecting speaker modules 10 in the vertical direction. Since the vertical directivity angle can be made smaller than or equal to 10 degree over the entire frequency range, acoustic signals can be transmitted so as to cover a prescribed range in the horizontal direction while being spread only little in the vertical direction. As such, the speaker array 5 is given good acoustic characteristics because the interference between sets of acoustic signals that are output from the speaker modules 10 constituting it can be reduced to a large extent.

The speaker module 10 and the speaker array 5 may be used in large-scale places that require very loud acoustic signals such as concert places and stadiums that accommodate a very large number of people.

As described above, each MF/HF driver unit 40 is equipped with the MF/HF drivers 41 and 42 (an example of the term "first acoustic drivers" used in the claims) and the acoustic coupler 45. The MF/HF drivers 41 and 42 output plural respective sets of middle/high-frequency acoustic signals (an example of the term "first acoustic signals" used in the claims). The acoustic coupler 45 has the acoustic passages 47 and 48 which receives, at the plural respective inlets IN1 and IN2, the plural respective sets of middle/high-frequency acoustic signals that are output from the MF/HF drivers 41 and 42. The acoustic passages 47 and 48 guide the plural sets of middle/high-frequency acoustic signals received at the plural inlets IN1 and IN2 to the common outlet OT. The acoustic passages 47 and 48 combine the plural sets of middle/high-frequency acoustic signals at the common outlet OT to generate combined acoustic signals (an example of the term "second acoustic signals" in the claims). The acoustic passages 47 and 48 output the combined acoustic signals. The lengths of the acoustic passages 47 and 48 from the inlets IN1 and IN2 to the outlet OT are identical to each other.

The speaker module 10 can produce large acoustic energy because it outputs acoustic signals using the plural acoustic drivers (MF/HF drivers 41 and 42). Furthermore, since the lengths of the acoustic passages 47 and 48 of the acoustic coupler 45 are identical, the lengths over which respective sets of acoustic signals are transmitted are the same in the entire frequency range. Thus, in the speaker module 10, the phase deviation between sets of acoustic signals can be suppressed in the entire frequency range. As a result, the speaker module 10 can secure large acoustic energy while the phase deviation between sets of acoustic signals that are output from the respective MF/HF drivers 41 and 42 is reduced.

In the acoustic coupler 45, degradation of the phase characteristic is suppressed in a reproduction frequency range of the speaker module 10 through sets of acoustic signals coming from the plural acoustic drivers are combined there. Where the reproduction frequency range is the entire frequency range, the phases can be kept the same over the entire frequency range because the plural acoustic passages 47 and 48 have the same length.

Each of the acoustic passages 47 and 48 may narrow in the vertical direction as the position goes from the inlet IN1 or IN2 to the outlet OT. The "vertical direction" may be the direction perpendicular to the horizontal direction which is the arrangement direction of the MF/HF drivers 41 and 42. Each of the acoustic passages 47 and 48 may narrow in such a manner that the ceiling wall F3 and the bottom wall F4 (an example of the term "walls arranged in the direction perpendicular to the arrangement direction of the plural acoustic passages") may form an angle 1 degree with the imaginary axes AX1 (an example of the term "first imaginary axes" used in the claims), respectively. The imaginary axes AX1 are acoustic center lines (an example of the term "first acoustic center lines" used in the claims) of sets of medium/high-frequency acoustic signals that pass through the acoustic passages 47 and 48, respectively.

With this measure, in the speaker module 10, since the acoustic passages 47 and 48 are narrowed in the vertical direction, expansion of acoustic signals in the vertical direction can be suppressed; the vertical directivity angle can be made smaller than or equal to 10 degree, for example. Since sets of acoustic signals travel in phase through the acoustic passages 47 and 48, they can be transmitted with their acoustic energy kept constant. Furthermore, the sets of acoustic signals reach the outlet OT of the acoustic coupler 45 at the same time, the phase deviation can be suppressed at each frequency in the speaker module 10. Thus, in the speaker array 5 which is constructed by connecting speaker modules 10 in the vertical direction, sets of acoustic signals that are output from speaker modules 10 adjoining in the vertical direction are not prone to interfere with each other and hence degradation in sound quality can be suppressed.

Each of the acoustic passages 47 and 48 may narrow in the horizontal direction as the position goes from the inlet IN1 or IN2 to the outlet OT. The inside side walls F1 of the acoustic passages 47 and 48 may form an angle 96 degree with walls F2, located outside the inlets IN1 and IN2, of the attachment portions 51 and 52, respectively.

With this measure, in the speaker module 10, since the acoustic passages 47 and 48 are narrowed in the horizontal direction, expansion of acoustic signals in the horizontal direction can be suppressed. The horizontal directivity angle can be made smaller than or equal to 90 degree, for example, because of the horizontal angle formed by the acoustic passages 47 and 48. Since sets of acoustic signals travel in phase through the acoustic passages 47 and 48, they can be transmitted with their acoustic energy kept constant. Furthermore, the sets of acoustic signals reach the outlet OT of the acoustic coupler 45 at the same time, the phase deviation can be suppressed at each frequency in the speaker module 10.

The speaker module 10 may also be equipped with the LF drivers 31 and 32 (an example of the term "plural second acoustic drivers" used in the claims) which output sets of low-frequency acoustic signals (an example of the term "sets of third acoustic signals" used in the claims) which are lower in frequency than middle/-high-frequency acoustic signals. The distance between the output openings 31*z* and 32*z* (an example of the term "plural second outlets"), from which the sets of low-frequency acoustic signals are output, of the LF drivers 31 and 32 may be determined on the basis of a frequency bandwidth (e.g., 500 Hz) of the sets of low-frequency acoustic signals.

With this measure, in the speaker module 10, the acoustic centers distance of the LF drivers 31 and 32 can be shortened according to the frequency bandwidth, whereby the phase difference between sets of acoustic signals that are output from the respective LF drivers 31 and 32 can be made smaller than 90 degree, for example. In this case, in the speaker module 10, sets of low-frequency acoustic signals are not rendered opposite in phase and hence reduction of acoustic energy can be suppressed.

The LF drivers 31 and 32 may be disposed in such a manner that the imaginary axes AX3*a* and AX3*b* (an example of the term "second imaginary axes" used in the claims) which are the acoustic center lines (an example of the term "second acoustic center lines" used in the claims) of sets of low-frequency acoustic signals are inclined by an angle 8 degree with respect to the imaginary axis AX2 in such directions that the output openings 31*z* and 32*z* come closer to each other.

With this measure, in the speaker module 10, since the output openings 31*z* and 32*z* of the LF drivers 31 and 32 are set closer to each other, the acoustic centers distance of the LF drivers 31 and 32 can be made shorter. As a result, in the speaker module 10, phase deviation is not prone to occur between sets of low-frequency acoustic signals.

Although in the embodiment the LF drivers 31 and 32 handle audio signals in the same frequency band that is lower than or equal to 500 Hz, they may handle audio signals in different frequency bands. For example, the LF drivers 31 and 32 may function as an LF driver to handle an audio signal in a first band that is lower than or equal to 250 Hz, for example, and an LF driver to handle an audio signal in a second band (e.g., 250 to 500 Hz) that is higher than the first band. A 4-way speaker system can be constructed in this manner. In the speaker module 10, where the two LF drivers 31 and 32 handle audio signals in different frequency bands, since these frequency bands are separated from each other, phase deviation is not prone to occur and hence phase interference is suppressed even if the acoustic centers distance of the LF drivers 31 and 32 is a little long.

The speaker module 10 and the speaker array 5 of the first embodiment are supplementary described in the below, using different expressions.

The system of the first embodiment may be applied to a professional loudspeaker system designed to be used in any application requiring a high acoustic output speaker system with excellent vertical and horizontal radiation characteristics, as well as excellent phase response and capable of being used in small to large venues of any type.

The system may be applied to a family of loudspeakers which may be known in the trade and familiar to those in the art, as line array loudspeakers.

A line array loudspeaker requires a non-spherical, vertically oriented planar wave front in order to properly combine vertical elements and in order to create near field and far field excellent phase and frequency response.

The system as described herein includes a vertical line array speaker element (for example, the speaker module 10). Multiple such systems are used in a vertical combination to create a vertical coverage required to provide excellent sound in a venue requiring the amplification of speech, film, live music and other such applications requiring the amplification of sound. The system as described herein covers the audio frequency range from approximately 45 Hz to 20 KHz. Frequency ranges less than this may be also imagined and covered by the works contained herein.

The system as described herein includes a three-way loudspeaker system (described as having three bandwidths, covering the low frequency, mid frequency and high frequency portions of the audio spectrum, via low frequency, mid frequency and high frequency devices, of which the mid and high frequency devices (for example, MF/HF drivers 41, 42) are contained within a coaxial set of electro-acoustic drivers (for example, MF/HF driver unit 40)). The apparatus of the embodiments is applicable to a two way system, as well as a four way system, inclusive of systems using passive, active or a combination, crossover systems, and employing from two to three amplifier subsystems, which are driven in a band-split method via the crossover systems, and driving the low, mid and high frequency sections of the speaker, or any combination thereof.

Many means are used to create a necessary planar wave front required for a vertical line array system (for example, the speaker array 5) and vertical line array system element (for example, the speaker module 10).

According to embodiments, a two way coaxial planar driver from the company BMS, containing a mid-range element and a high-frequency element in a coaxial fashion may be used with means of creating a planar wave front, both wave fronts exiting through a common acoustic mouth (for example, the outlet OT), as a single part. Other such products would be available and would be applicable to a design such as described herein.

Such coaxial planar drivers may be used in line array loudspeaker system design.

The novel and unique design described and taught herein uses coaxial planar drivers in a unique way to create more acoustic energy, while maintaining a planar wave front with excellent frequency and phase response, combined to a planar wave front waveguide and inclusive of means of coupling low frequency transducers in a means of defining a novel line array loudspeaker element. Portions of the designs taught herein may be used by those skilled in the art to create variations of these designs and such systems are envisioned and included as part of the intent and scope of the invention.

The system as described herein may use four coaxial planar wave drivers, arranged in a dual side by side configuration, that is stacked vertically with another two drivers in a side by side coaxial array, for a total of four coaxial drivers. The system as described herein may be applied also to a system using as few as two coaxial planar drivers arranged side by side, and as many as eight planar coaxial drivers, arranged in a side by side and stacked manner, similar to the use of the four drivers as described herein. Such systems and designs may include a low frequency element in order to make a full range loudspeaker system, although bandwidth limited designs using only the coaxial drivers are also envisioned and included as part of the scope of this invention.

Various means may be used to couple the three band passes (low frequencies, mid frequencies and high frequencies) into the acoustic space.

The intent of the systems described herein is to improve on several key aspects, using novel and new means of implementation.

According to embodiments, mid-range and high frequency sensitivity and power handling are increased by combining a multiplicity of coaxial planar drivers in such a way that their acoustic energy combines without destructive interference, in order to increase the acoustic output while preserving excellent phase and frequency response, as well as preserving the integrity of the acoustic planar wave front.

According to embodiments, planar coaxial drivers feed a common coupling throat and common waveguide.

According to embodiments, low frequency transducers are coupled to the closely integrated mid range and high frequency range waveguide with minimal low frequency disturbance while maintaining a good coupling in order to preserve the horizontal radiation of the low frequency drivers. Note that as taught herein, the system may be used as a four-way system by sending separate band-limited information to each woofer (for example, LF drivers 31, 32), in such a way that only at very low frequencies are both low frequency drivers used, therefore improving the low mid and low frequency horizontal coverage.

According to embodiments, driver to driver separation is decreased, thereby improving phase and frequency response of the system as a whole—including the low frequency elements coupled to the mid/high frequency coaxial elements.

As described herein, the system may use a coaxial type speaker configuration for the mid and high frequency range. A satisfactory phase characteristic is realized by reducing the acoustic center distance difference of each coaxial unit.

Fixed horizontal directivity is realized with respect to middle range frequencies and high frequencies by constructing a horn shape having a curvature that realizes appropriate and desired horizontal directivity (in this case 90 degrees and those practiced in the art realize that any suitable horizontal pattern may be reasonably obtained by the inventions described herein and are within the scope of the invention taught herein).

According to embodiments, a speaker system design that has an acoustic characteristic which is uniform and has little phase disturbance (ideal phase response) within a coverage area, in the vertical and horizontal domains is realized.

According to embodiments, the system may specifically utilize a unique planar wave coupler coupled to a planar wave guide, in such a manner as to create an effective planar wave front of specific dimensions for use as a portion of a line array speaker element.

It shall be apparent to those in the art that the coupler described herein may also be used without the waveguide, as a diffraction slot device, in order to easily create a wide horizontal coverage device.

The line array speaker element described herein may include drivers having: two×12 inch cone drivers; and four (arranged in a two by tow pattern) coaxial drivers.

Those practiced in the art can easily see that other configurations may be easy to derive based on the teachings herein and are envisioned as part of the present invention.

The apparatus of embodiments is described in more detail, hereinafter.

By adopting plane wave coaxial drivers, connecting two drivers so as to be in phase by a horizontal angle of 41 degrees to 43 degrees through the use of an acoustic path called a coupler, and joining the connected coupler and driver vertically, vertical directivity of 10 degrees or less is realized. Acoustic energy is transmitted to a wave guide through the coupler, to radiate the acoustic energy.

By connecting the two drivers up and down, and combining coaxial planar wave drivers which are four pieces in total, units having high sensitivity and high power handling are realized.

With regard to the coupler, it is designed so as to have an inclination angle of substantially 96 degrees as the acoustic path on a horizontally inner side, and to have an inclination angle of substantially minus 1 degree in a vertical direction, in order to narrow down directivity in the vertical direction with in-phase.

With regard to the wave guide, it is realized by having a narrow space at a place close to an acoustic center, and expanding an aperture rate in a horizontal direction gradually from there, in order to keep a constant horizontal directional characteristic.

As a three way (low frequency, mid frequiency and high frequency) line array speaker (as described herein, although two or 4 way systems are also envisioned), an acoustic center distance of a LF unit, a MF unit, a HF unit is configured to be between radius 260 cm to 280 cm. The system as described herein may be realized with different size low frequency drivers and different quantities of coaxial or non-coaxial drivers and are envisioned and included as part of this invention.

In order to eliminate a distance difference (phase and frequency disturbance) between the LF unit and the MF/HF unit, the LF unit is inclined by substantially 8 degrees, to realize a satisfactory characteristic acoustically. Others angles may be used and are included in this invention by way of our vision.

Note that non-coaxial planar wave drivers may be used in the systems described herein and still be within the scope of this invention.

By having the above-described features, realized is a speaker system which has characteristics of very little phase disturbance, excellent frequency response and uniform horizontal and vertical directional characteristic, including a vertical directional characteristic of 10 degrees or less (directivity angle necessary as a line array speaker), and has high power handling (MF:600W, HF300W: from unit AES specification), by precisely connecting the four drivers by means of the coupler. Note that other designs may be envisioned which include less than 10 degree vertical coverage or more than 10 degree vertical coverage and are included as part of the scope herein.

FIGS. 4 and 5 are views of a coupler (which shows an angle) showing one half of the design as described herein. The design described herein includes a total of 4 drivers, arrange as two side by side as shown in FIGS. 4 and 5, and another similar assembly below it, all sharing the same coupling device as shown.

FIG. 10A is a perspective view of a wave guide, and FIG. 10B is a top view of the wave guide.

FIG. 3 shows a unit layout. Acoustic center distance may be set 260 cm to 280 cm.

FIG. 11A shows a vertical coverage of the line array speaker described herein. FIG. 11B shows a horizontal coverage of the line array speaker. As indicated in FIGS. 11A and 11B, excellent coverage over the frequency response in the vertical and horizontal direction is realized.

FIGS. 12A and 12B serve to indicate the excellent performance of the waveguide as coupled to the coupler described herein.

FIG. 12A shows the mechanical design (one half shown) of the wave guide, while FIG. 12B shows the same view of the wave guide and serves to indicate the excellent phase response of the system (indicated by the nearly straight color bands of acoustic energy as the propagate and leave the wave guide).

FIGS. 13, 14A and 14B serve to compare the system as described herein to two competitive and similar systems from others. The speaker as described herein is show in FIG. 13 as the RAMSA WS-LA4. The line e1 through the horizontal center of FIG. 13 would be indicative of a perfect speaker. Shown above and below the line e1 is the deviation from perfect. Note that in the case of the WS-LA4 as shown in the line g1, very little deviation is noted, compared to the two competitive speakers as shown in the lines g2 and g3.

Embodiment 2

The first embodiment is directed to the 3-way speaker system including the LF drivers, the MF drivers, and the HF drivers (actually, MF/HF driver units). In contrast, the second embodiment is mainly directed to a 2-way speaker system including LF drivers and an HF driver.

In describing each of speaker modules 110 according to the second embodiment, components having the same ones in each of the speaker modules 10 according to the first embodiment will be given the same reference symbols as the latter and descriptions therefor will be omitted or simplified.

Figure 16:
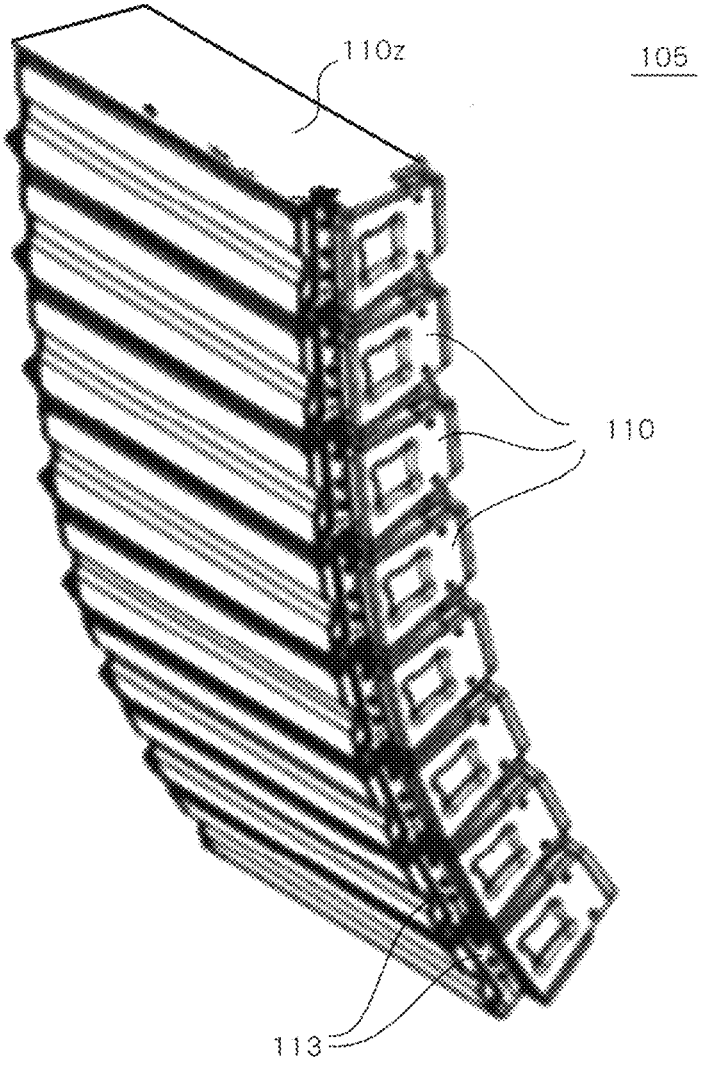
FIG. 16 shows an example appearance of a speaker array according to a second embodiment.

FIG. 16 shows an example appearance of a speaker array 105 according to the second embodiment. The speaker array 105 includes plural speaker modules 110 which are connected to each other to form a curved line. The top surface and the bottom surface of a case 110*z* of each speaker module 110 adjoins and is joined to the bottom surface of a case 110*z* of a speaker module 110 located above and the top surface of a case 110*z* of a speaker module 110 located below, respectively. As in the first embodiment, the vertical range to be covered by the speaker array 105 is varied by changing the number of speaker modules 110 combined together to form a curved line. On the other hand, the horizontal dispersion angle of acoustic signals of the speaker array 105 is kept constant even if the number of speaker modules 110 combined together is changed.

Figure 17A:
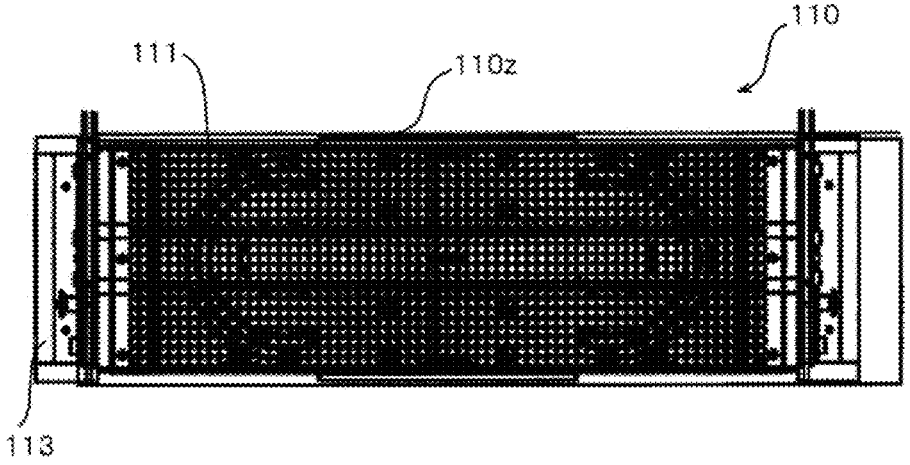
FIG. 17A is a front view showing an appearance of a speaker module.
Figure 17B:
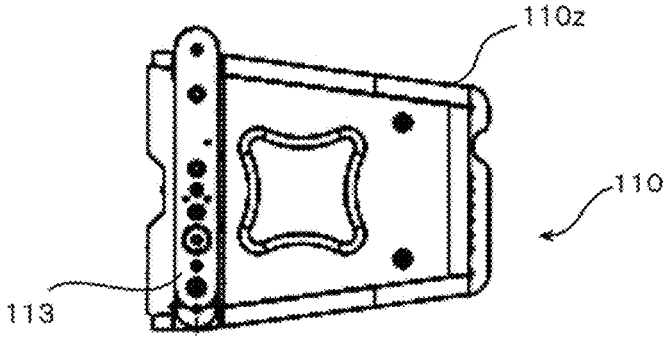
FIG. 17B is a side view showing an appearance of the speaker module.

FIGS. 17A and 17B are a front view and a side view, respectively, showing an appearance of each speaker module 110. The speaker module 110 has the case 110*z* which is substantially cuboid shape. A water-repellent waterproof sheet 111 for preventing entrance of rain water etc. is disposed at the front of the case 110*z*. A grip 113 to be used for holding the speaker module 110 is attached to each of the side surfaces of the case 110*z* at a front position.

Figure 18:
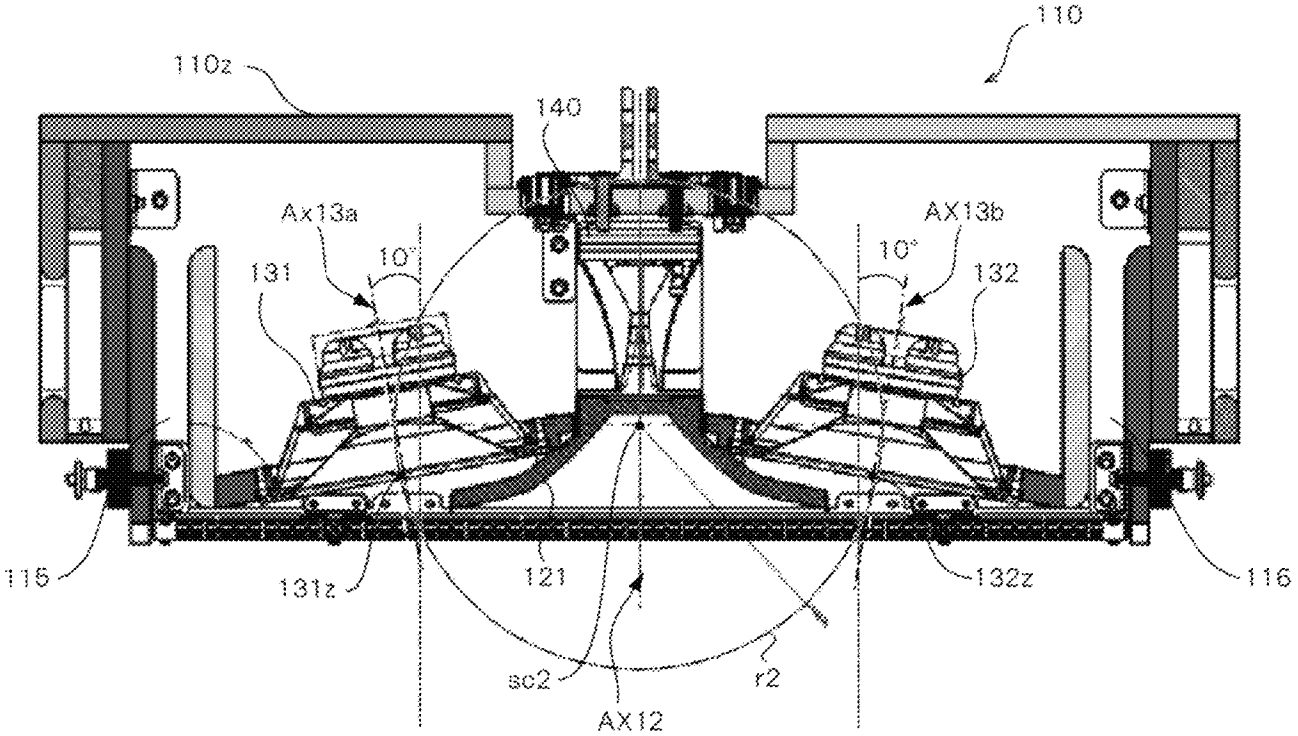
FIG. 18 is a sectional view showing an example configuration of the speaker module.

FIG. 18 is a sectional view showing an example configuration of the speaker module 110. More specifically, FIG. 18 is a sectional view of the speaker module 110 taken by a horizontal plane including the longitudinal direction of the case 110*z*. A waveguide 121 is disposed at the center-front of the case 110*z*.

The speaker module 110 is equipped with LF drivers 131 and 132 which output low-frequency (lower than or equal to 1 kHz) acoustic signals and HF drivers 140 which output high-frequency (higher than 1 kHz) acoustic signals. Unlike the speaker module 10 according to the first embodiment, the speaker module 110 is not equipped with an acoustic coupler.

The HF drivers 140 are disposed in the rear of the waveguide 121 so as to be arranged in two stages in the vertical direction. For example, each HF driver 140 is 1.75-inch speaker. Each HF driver 140 outputs high-frequency acoustic signals forward of the case 110*z*. The waveguide 121 diffuses, uniformly, in the horizontal direction of the case 110*z*, high-frequency acoustic signals that are output from the HF drivers 140.

The LF drivers 131 and 132 are disposed at the front of the case 110*z* on the two respective sides of the waveguide 121. The LF drivers 131 and 132, which are 8-inch acoustic drivers, for example, output low-frequency acoustic signals forward of the case 110*z*. Low-frequency acoustic signals that are output from the LF drivers 131 and 132 are low in directivity and can partly be output from, for example, the back sides of the LF drivers 131 and 132. Although two LF drivers are provided in the embodiment, the number of LF drivers may be three or more.

Rear passages 115 and 116 are formed at the respective side ends of the case 110*z* on the front side using bass reflex ports BP2. Communicating with the back sides of the LF drivers 131 and 132, respectively, the rear passages 115 and 116 guide low-frequency acoustic signals that are output from the back sides of the LF drivers 131 and 132 to front portions of the case 110*z*.

In the horizontal direction (left-right direction in FIG. 18), the two LF drivers 131 and 132 may be arranged symmetrically with respect to the HF drivers 140. In this case, the center line of acoustic signals that are output from the speaker module 110 (acoustic center line) coincides with the acoustic center line of high-frequency acoustic signals that are output from the HF drivers 140. The acoustic center line of high-frequency acoustic signals that are output from the HF drivers 140 is shown as an imaginary axis AX12 in FIG. 18.

As shown in FIG. 18, an acoustic center position sc2 is set at a prescribed position on the acoustic center line of the speaker module 110. For example, the prescribed position is a position where the imaginary axis AX12 intersects a middle line of the waveguide 121.

The distance from the acoustic center position sc2 to each of output openings 131*z* and 132*z* of the LF drivers 131 and 132 may be determined on the basis of a frequency bandwidth of low-frequency acoustic signals.

More specifically, where the frequency bandwidth of low-frequency acoustic signals is smaller than or equal to 1 kHz, the centers of the output openings 131*z* and 132*z* of the LF drivers 131 and 132 are set on a circle r2 around the acoustic center position sc2 having a radius 165 to 175 mm (e.g., 169 mm). For example, where the frequency bandwidth of low-frequency acoustic signals is equal to 1 kHz, a phase deviation permissible range ¼×λ is about 9 cm. Thus, the acoustic centers distance may be set using this value as a rough measure.

As for the LF drivers 131 and 132, imaginary axes AX13 (AX13*a* and AX13*b*) which are acoustic center lines of low-frequency acoustic signals may be inclined by 10 degree with respect to the imaginary axis AX12. That is, the LF drivers 131 and 132 may be installed so as to be inclined by 10 degree with respect to the imaginary axis AX12 in such directions that their output openings 131*z* and 132*z* come closer to each other. By inclining the output openings 131*z* and 132*z* of the LF drivers 131 and 132 inward in this manner, the output openings 131*z* and 132*z* come closer to each other (i.e., their distance becomes shorter) and hence their acoustic centers distance can be made shorter. As a result, the phase deviation between sets of low-frequency acoustic signals that are output from the respective LF drivers 131 and 132 can be reduced. The inclination angle (10 degree) may be determined according to the size of the case 110*z* and frequency bandwidth of acoustic signals.

Since the inclination angle 10 degree of the LF drivers 131 and 132 is greater than the inclination angle 8 degree of the LF drivers 31 and 32 employed in the first embodiment, the acoustic centers distance of the former is shorter than the latter. Although the LF drivers 131 and 132 output low-frequency acoustic signals that are lower than or equal to 1 kHz and hence include frequency components that the LF drivers 31 and 32 do not produce, increase of phase deviation can be suppressed by the shortening of the acoustic centers distance. By suppressing increase of phase deviation, the LF drivers 131 and 132 can minimize side lobes and thereby improve the acoustic characteristics.

Figure 19A:
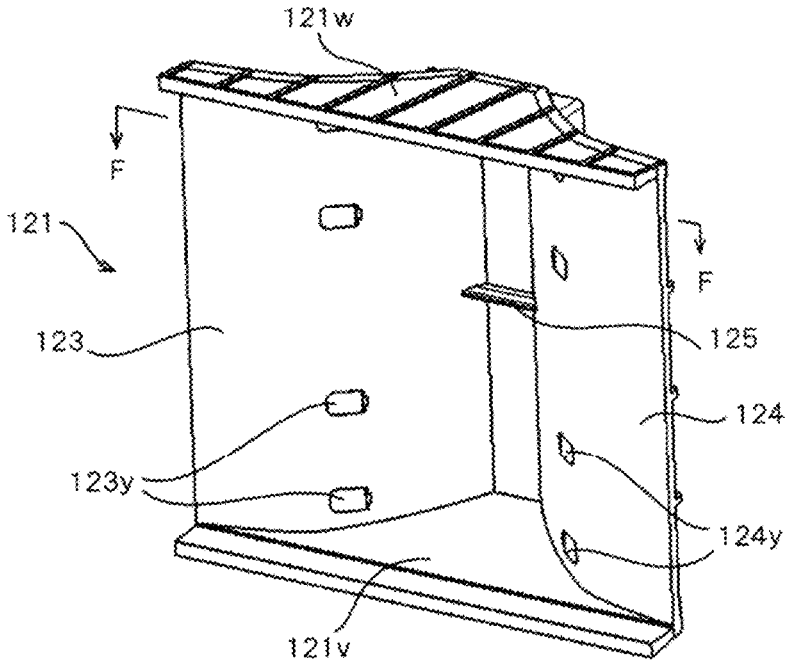
FIG. 19A is a perspective view showing an appearance of a waveguide.
Figure 19B:
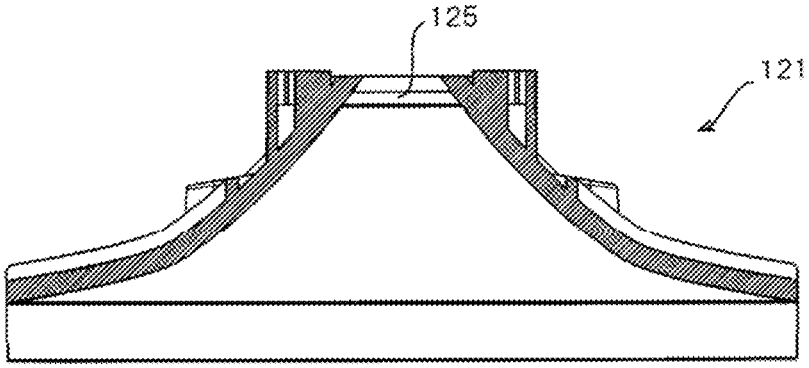
FIG. 19B is a sectional view of the waveguide taken along line F-F in FIG. 19A.

FIG. 19A is a perspective view showing an appearance of the waveguide 121, and FIG. 19B is a sectional view of the waveguide 121 taken along line F-F in FIG. 19A.

The waveguide 121 has two curved resonance plates 123 and 124, as a result of which the waveguide 121 can secure prescribed horizontal directivity (e.g., 90 degree). In the speaker module 110, the space that is formed in front of the resonance plates 123 and 124 is narrow in a region close to the output opening of the HF driver 140 and their horizontal aperture ratio (i.e., the interval between them) increases gradually as the position goes forward in the acoustic signal traveling direction from the output opening of the HF driver 140.

The space between the resonance plates 123 and 124 serves for input of acoustic signals that are output from the HF drivers 140 disposed in the rear of the waveguide 121 and for output of acoustic signals that are output from the waveguide 121 while being diffused in the horizontal direction.

A projection 125 connects the resonance plates 123 and 124. The projection 125 functions as a partition for division in the vertical direction and may also function as an acoustic coupling port. The projection 125 helps to connect two sets of acoustic signals that are output from the two respective HF drivers 140 arranged in the vertical direction by smoothing their wavefronts, and can thereby suppress interference between them.

Each of the resonance plates 123 and 124 is formed with, for example, six screw holes 123*y* or 124*y* to be used for fixing the waveguide 121 to the case 110*z* of the speaker module 110. The HF drivers 140 which are arranged in two stages in the vertical direction are attached to inside portions of the rear end surfaces of the resonance plates 123 and 124. The LF drivers 131 and 132 are attached to the back surfaces of the resonance plates 123 and 124 at positions that are spaced from each other in the horizontal direction.

A top plate 121*w* and a bottom plate 121*v* are joined to the resonance plates 123 and 124 to reinforce the waveguide 121. The top plate 121*w* and the bottom plate 121*v* can suppress expansion of sound in the vertical direction. The respective inner surfaces of the top plate 121*w* and the bottom plate 121*v* may be slightly curved outward as the position goes in the traveling direction of acoustic signals, which improves connection (summation) of sets of acoustic signals that are emitted from the waveguide 121. As a result, phase interference is not prone to occur between acoustic signals that are output from one speaker module 110 and acoustic signals that are output from each or the adjoining speaker module 110.

Figure 20:
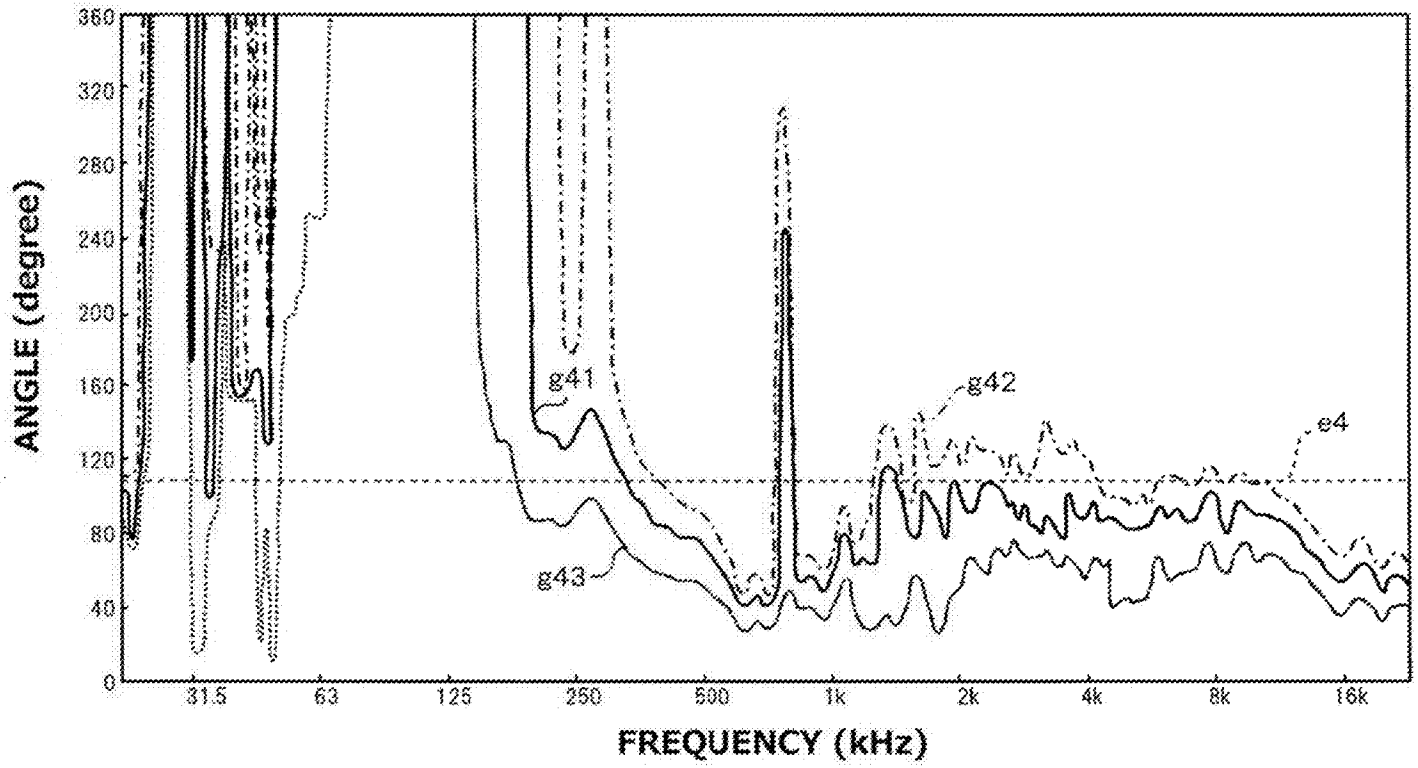
FIG. 20 is a graph showing a relationship between frequency and horizontal directivity angle (measured value) of acoustic signals that are output from HF driver.

FIG. 20 is a graph showing a relationship between the frequency and the horizontal directivity angle (measured value) of acoustic signals that are output from each HF driver unit 140 employed in the embodiment. The horizontal axis and the vertical axis represent the frequency and the horizontal directivity angle of acoustic signals, respectively. The same method for measuring acoustic signals as in the first embodiment was employed.

In FIG. 20, a broken line e4 indicates an ideal characteristic. Curves g41, g42, and g43 are a −6 dB contour line, a −9 dB contour line, and a −3 dB contour line, respectively. In FIG. 20, the horizontal directivity angle of curve g41 (−6 dB contour line) is approximately constant (about 90 degree) in a frequency range that is higher than or equal to 1 kHz. This coincidence occurs at the horizontal directivity angle 90 degree. Thus, in the speaker module 110, by making adjustments so that acoustic signals are output from the waveguide 121 in an angle range of 90 degree, the acoustic signals can be radiated with reduced loss of acoustic energy.

Figure 21:
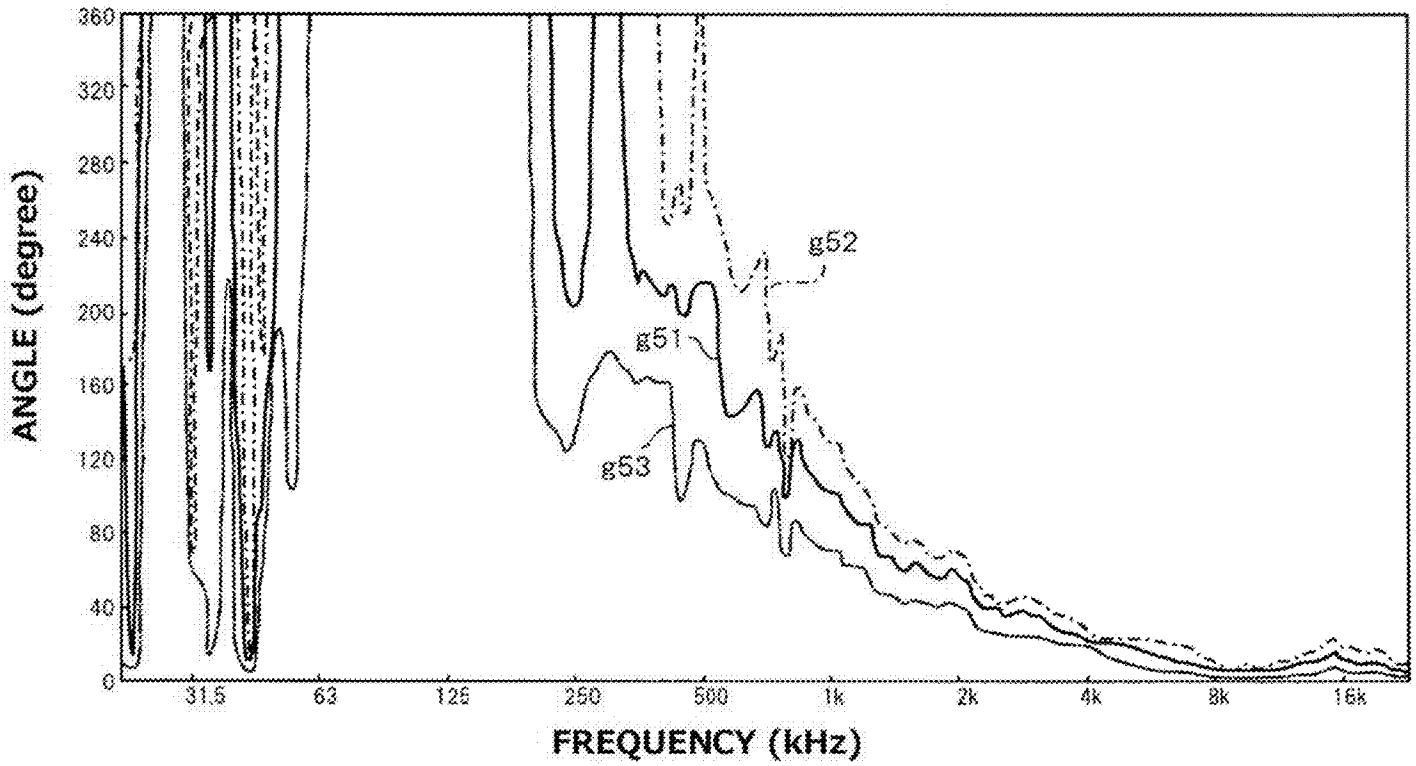
FIG. 21 is a graph showing a relationship between frequency and vertical directivity angle (measured value) of acoustic signals that are output from HF driver.

FIG. 21 is a graph showing a relationship between the frequency and the vertical directivity angle (measured value) of acoustic signals that are output from each HF driver unit 140 employed in the embodiment. The horizontal axis and the vertical axis represent the frequency and the vertical directivity angle of acoustic signals, respectively. The same method for measuring acoustic signals as in the first embodiment was employed.

In FIG. 21, curves g51, g52, and g53 are a −6 dB contour line, a −9 dB contour line, and a −3 dB contour line, respectively. The −6 dB contour curve g51 shown in FIG. 21 is such that in a frequency range that is higher than or equal to 1 kHz the vertical directivity angle decreases gradually and then comes to exhibit an approximately constant value of 10 degree as the frequency increases.

As described above, in the speaker module 110 which is a 2-way speaker system, since the HF drivers 140 and the LF drivers 131 and 132 are disposed within a proper acoustic centers distance, acoustic signals that are small in phase disorder and have a uniform horizontal directivity characteristic can be produced. In the speaker module 110, sets of high-frequency acoustic signals that are transmitted from the HF drivers 140 which are arranged in two stages in the vertical direction can be combined with each other. Furthermore, in the speaker module 110, the vertical directivity angle can be set at 10 degree or smaller without using an acoustic coupler.

The speaker array 105 may be constructed by connecting speaker modules 110 in the vertical direction. Since the vertical directivity angle can be made smaller than or equal to 10 degree over the entire frequency range, acoustic signals can be transmitted so as to cover a prescribed range in the horizontal direction while being spread only little in the vertical direction.

The speaker module 110 and the speaker array 105 can be used as a speaker system for general purposes or for home use. In this case, the sizes of the speaker module 110 and the speaker array 105 may be made smaller than those of the speaker module 10 and the speaker array 5 according to the first embodiment.

The speaker module 110 and the speaker array 105 may be a 1-way system. Although a 1-way system is a one audio signal channel when viewed from, for example, an amplifier, a high-frequency audio signal and a low-frequency audio signal may be generated by frequency-separating an amplified audio signal by a filter that is an analog circuit formed on a board.

The speaker module 110 may be implemented as a self-completed module by incorporating amplifiers into it. Amplifiers may be provided outside the speaker module 110. Although in the second embodiment the LF drivers 131 and 132 handle audio signals in the same frequency band (lower than or equal to 1 kHz), they may handle audio signals in different frequency bands.

For example, the LF drivers 131 and 132 may function as an LF driver to handle an audio signal in a first band that is lower than or equal to 500 Hz, for example, and an LF driver to handle an audio signal in a second band (e.g., 500 Hz to 1 kHz) that is higher than the first band. A 3-way speaker system can be constructed in this manner. Where the two LF drivers 131 and 132 handle audio signals in different frequency bands, since these frequency bands are separated from each other, phase deviation is not prone to occur and hence phase interference is suppressed even if the acoustic centers distance of the LF drivers 31 and 32 is a little long.

The speaker module 110 and the speaker array 105 of the embodiments are supplementary described in different expressions, in the below.

According to embodiments, the loudspeaker system (for example, including the speaker module 110 and the speaker array 105) has unique features and properties.

The system is of a line array speaker module, intended to be used in vertical arrays of two or more speaker modules, in order to form a high power loudspeaker system of varying vertical coverage angle, with fixed horizontal dispersion angle.

In the systems of line array speaker type, a planar or relatively non-expanding wave front is required in order to allow successful use in a vertical line array format.

Various means have been discussed in related art of achieving the required planar shaped wave front.

According to related art, a planar wave front from the midrange and high frequencies is obtained with different means.

Such means includes various types of waveguides to shape the wave pattern acoustically, while ensuring good frequency and phase response in the middle and high frequencies.

According to related art, various systems are exposed and consist of various sized drivers, number of drivers, along with differing means of pattern control and planar wave front generation.

According to embodiment of the invention, a different approach is taken to solving the key requirements for a line array module.

According to embodiments, a mid/hi frequency driver which is made by BMS in Germany, part number 4510ND may be used.

Although this unit almost supplies required planar wave front, an addition of an acoustic dispersion restricting device is required.

The acoustic dispersion restricting device serves to allow the planar wave front to expand horizontally to a horizontal pattern of approximately 90 degrees.

Note that it is readily apparent to those skilled in the art, that other horizontal dispersion patterns may be made, including asymmetrical patters and user variable horizontal patterns and all such derivatives are within the scope of this invention.

The line array speaker system also includes two 8 inch cone drivers, on each side of the acoustic dispersion restricting device, to create low frequency energy.

In order to match the planar wave front to that of the 8 inch driver, and to increase SPL sensitivity and power handling, two such planar devices are stacked vertically, and the entire summation of the planar wave front feeds a common entrance port in the acoustic dispersion restricting device.

For best line array element summation as devices are added vertically, the output of the acoustic dispersion restricting device should equal approximately 10 degrees of vertical dispersion.

The line array element described herein allows for substantially 10 degrees of vertical dispersion.

The spacing between the 8 inch drivers may be such that they sum perfectly in the horizontal domain, and that side lobes and other such off-axis problems are minimized, which would normally be created by having a pair of horizontally adjacent drivers.

This is achieved several ways as follows.

The drivers are placed partially behind the acoustic dispersion restricting device, which allows the proper spacing up to the crossover point.

Due to the relatively large size of the 8 inch driver, the 8 inch driver appears acoustically as a smaller driver as it approaches the crossover point, transitioning from upper bass to mid range. This is achieved by the angle of the 8 inch drivers and the fact that the rear of the acoustic dispersion restricting device acts as a further acoustic restricting device to make the 8 inch driver appear as a 4 inch driver acoustically.

Note that the line array element is typically used as a two-way device, but it will be apparent to those skilled in the art that the element may be operated as a three-way device by allowing on of the 8 inch drivers to operate in a band-pass mode so that, at low frequencies, both 8 inch drivers are used, but at higher frequencies, the energy is coupled more into a single 8 inch driver, allowing for better off axis horizontal lobe control.

The line array element is of a symmetrical design, with mid and high frequency drivers placed in the middle of the element and the low frequency drivers placed to the left and the right.

The symmetry helps to guarantee required on and off axis symmetry of the line array element.

Embodiments may be further described as follows:

1) A Line array speaker element;

2) A line array speaker element of the design disclosed herein and it's logical derivatives;

3) The line array speaker element as described herein consisting of two planar mid-hi drivers and two low frequency drivers;

4) The line array speaker element as described herein utilizing two or more planar drivers arrayed vertically and entering a common coupling port;

5) The line array speaker element as described herein containing an acoustic dispersion restricting device covering the frequency range from mid to hi frequencies;

6) The line array speaker element as described herein in which the vertically arrayed planar drivers are coupled to a common coupling port, the exit of which comprises an acoustic dispersion restricting device;

7) The line array speaker element as described herein containing two 8 inch low frequency drivers, arranged in a horizontally symmetrical pattern;

8) The line array speaker element as described herein in which the vertically arrayed planar mid-hi drivers are in the center of the array of two 8 inch low frequency drivers.

9) The line array speaker element as described herein which includes a means of close coupling the 8 inch low frequency drivers in such a way as to improve and limit the horizontal dispersion by proper angling of each 8 inch driver towards the center of the line array speaker element;

10) The line array speaker element as described herein which includes a means of coupling the 8 inch low frequency drivers up to the crossover frequency of the mid-hi planar drivers via an acoustic shadowing device to make the 8 inch drivers appears as smaller drivers near the crossover point;

11) A method described in the above 10) which is the rear of the mid-hi frequency acoustic dispersion restricting device;

12) The line array speaker element as described herein which is of a compact design and includes the required mechanical means to connect the boxes together in order to form a larger vertical array, consisting of 2 or more such elements;

13) The line array speaker element as described herein which can be operated in an electronically driven two-way system, and band pass coupling three way system or a passive single way system;

14) The line array speaker element as described herein which can optionally include the required electronic elements to make it a fully self-contained, powered line array speaker element;

15) The line array speaker element as described herein which operates with a dispersion pattern of 90 degrees horizontally and nominally 10 degrees vertically.

Although the embodiments have been described above with reference to the drawings, it is apparent that the invention is not limited to these embodiments. It is apparent that those skilled in the art would easily conceive various changes or modifications within the confines of the claims, and such changes or modifications should naturally be construed as being included in the technical scope of the invention.

Although in the first embodiment two MF/HF drivers 41 and 42 are connected to one acoustic coupler 45, four MF/HF drivers may be connected to one acoustic coupler 45.

In the first and second embodiments, the waveguide 21 or 121 may be omitted. In this case, in the speaker modules 10 and 110, expansion of output acoustic signals is not restricted in the horizontal direction. Being non-directional in the horizontal direction, the speaker modules 10 and 110 can cover a wide range in the horizontal direction.

In the first and second embodiments, the horizontal direction and the vertical direction may be interchanged.

The invention is useful in realizing, for example, speaker apparatuses capable of reducing phase deviation between sets of acoustic signals that are output from respective acoustic drivers and outputting acoustic signals having large acoustic energy.

DESCRIPTION OF SYMBOLS

5, 105: Speaker array
10, 119: Speaker module
10*z*, 110*z*: Case
11, 111: Waterproof sheet
13, 113: Grip
15, 16, 115, 116: Rear passage
21, 121: Waveguide
23, 24, 123, 124: Resonance plate
23*y*, 24*y*, 123*y*, 124*y*: Screw hole
23*z*, 24*z*: Rib
31, 32, 131, 132: LF driver
31*z*, 32*z*, 131*z*, 132*z*: Output opening
40: MF/HF driver unit
41, 42: MF/HF driver
45: Acoustic coupler
47, 48: Acoustic passage
51, 52: Attachment portion
121*v*: Bottom plate
121*w*: Top plate
125: Projection
140: HF driver
AX1, AX2, AX3*a*, AX3*b*, AX12, AX13*a*, AX13*b*: Imaginary axis
IN1, IN2: Inlet
OT: Outlet
sc, sc2: Acoustic center position

What is claimed is:

1. A speaker apparatus comprising:

a plurality of first acoustic drivers configured to respectively output a plurality of first acoustic signals; and an acoustic coupler having a plurality of acoustic passages, wherein the plurality of acoustic passages respectively include inlets and include a common outlet, wherein the plurality of first acoustic signals output from the plurality of first acoustic drivers are respectively inlet into the inlets, the plurality of first acoustic signals inlet into the inlets are guided to the common outlet, the plurality of first acoustic signals are combined at the common outlet to generate a second acoustic signal, and the second acoustic signal is output from the acoustic coupler, wherein lengths of the plurality of acoustic passages from the inlets to the common outlet are identical to each other, wherein one of the plurality of acoustic passages is narrowed in a direction perpendicular to an arrangement direction of the plurality of first acoustic drivers as a position goes from the inlet to the common outlet, and wherein, in the one of the plurality of acoustic passages, an inner wall surface of the one of the plurality of acoustic passages arranged in the direction perpendicular to the arrangement direction inclines by an angle of substantially 1 degree with respect to a first imaginary axis corresponding to an acoustic center line of a corresponding one of the plurality of the first acoustic signals passing through the one of the plurality of acoustic passages.

2. A speaker apparatus comprising:

a plurality of first acoustic drivers configured to respectively output a plurality of first acoustic signals; and an acoustic coupler having a plurality of acoustic passages, wherein the plurality of acoustic passages respectively include inlets and include a common outlet, wherein the plurality of first acoustic signals output from the plurality of first acoustic drivers are respectively inlet into the inlets, the plurality of first acoustic signals inlet into the inlets are guided to the common outlet, the plurality of first acoustic signals are combined at the common outlet to generate a second acoustic signal, and the second acoustic signal is output from the acoustic coupler, wherein lengths of the plurality of acoustic passages from the inlets to the common outlet are identical to each other, wherein one of the plurality of acoustic passages narrows in an arrangement direction of the plurality of first acoustic drivers as a position goes from the inlet to the common outlet, and wherein, in the one of the plurality of acoustic passages, an inner wall surface of the one of the plurality of acoustic passages in the arrangement direction inclines by an angle of substantially 96 degree with respect to an end surface positioned outside of the inlet at an attachment portion to which corresponding one of the plurality of acoustic driver is attached and which forms the inlet.

3. A speaker apparatus comprising:

a plurality of first acoustic drivers configured to respectively output a plurality of first acoustic signals; and an acoustic coupler having a plurality of acoustic passages, wherein the plurality of acoustic passages respectively include inlets and include a common outlet, wherein the plurality of first acoustic signals output from the plurality of first acoustic drivers are respectively inlet into the inlets, the plurality of first acoustic signals inlet into the inlets are guided to the common outlet, the plurality of first acoustic signals are combined at the common outlet to generate a second acoustic signal, and the second acoustic signal is output from the acoustic coupler, wherein lengths of the plurality of acoustic passages from the inlets to the common outlet are identical to each other, wherein the speaker apparatus further comprises:

a plurality of second acoustic drivers configured to respectively output a plurality of third acoustic signals which are respectively lower in frequency than the plurality of first acoustic signals and the second acoustic signal, wherein the plurality of third acoustic signals from the plurality of the second acoustic drivers are respectively output from a plurality of second outlets, and wherein a distance between the plurality of second outlets is determined based on a frequency bandwidth of the plurality of third acoustic signals.

4. The speaker apparatus according to claim 3, wherein each of the plurality of second acoustic drivers is disposed in such a manner that a second imaginary axis corresponding to an acoustic center line of corresponding one of the plurality of third acoustic signals is inclined by an angle of substantially 8 degree with respect to an acoustic center line of the second acoustic signal.

* * * * *